US005633703A

United States Patent [19]

Takenouchi et al.

[11] Patent Number: 5,633,703

[45] Date of Patent: May 27, 1997

[54] IMAGE FORMING APPARATUS HAVING TRANSFER ROLLER AND SEPARATION BRUSH

[75] Inventors: Shigeki Takenouchi; Kazuhiko Sato, both of Hachioji, Japan

[73] Assignee: Konica Corporation, Japan

[21] Appl. No.: 304,394

[22] Filed: Sep. 12, 1994

[30] Foreign Application Priority Data

| | | | |
|---|---|---|---|
| Sep. 16, 1993 | [JP] | Japan | 5-230478 |
| Dec. 6, 1993 | [JP] | Japan | 5-305471 |
| Mar. 31, 1994 | [JP] | Japan | 6-063887 |

[51] Int. Cl.[6] ..... G03G 15/16

[52] U.S. Cl. ..... 399/315; 399/44; 399/66

[58] Field of Search ..... 355/271, 273, 355/272, 274, 276, 277, 208; 118/653

[56] References Cited

U.S. PATENT DOCUMENTS

| | | | |
|---|---|---|---|
| 5,070,369 | 12/1991 | Mahoney et al. | 355/271 |
| 5,083,167 | 1/1992 | Fukushima et al. | 355/274 |
| 5,128,717 | 7/1992 | Uchikawa et al. | 355/208 |
| 5,130,752 | 7/1992 | Morishita et al. | 355/274 |
| 5,146,285 | 9/1992 | Kikuchi et al. | 118/653 X |
| 5,317,371 | 5/1994 | Monma et al. | 355/274 |
| 5,379,099 | 1/1995 | Senba et al. | 355/208 X |

FOREIGN PATENT DOCUMENTS

| | | |
|---|---|---|
| 26068 | 2/1986 | Japan . |
| 300774 | 12/1990 | Japan . |

*Primary Examiner*—Sandra L. Brase

*Attorney, Agent, or Firm*—Jordan B. Bierman; Bierman, Muserlian and Lucas LLP

[57] ABSTRACT

An image forming apparatus has a photoreceptor which has a radius of curvature of more than 35 mm at a transfer position or a separation position, a transfer roller provided at the transfer position where the transfer roller faces the photoreceptor, a transfer power supply source to supply a predetermined DC bias current onto the transfer roller, a conductive brush-shaped separation device provided at the separation position where the separation device faces the photoreceptor, and a separation power supply source to supply a variable DC bias voltage onto the separation device.

13 Claims, 22 Drawing Sheets

P1 —●— Xerox 20 Lbs SHEET

P2 --■-- Xerox 24 Lbs SHEET

P3 —△— Konica 110 Kg SHEET

P4 —○— Konica 55 Kg SHEET

P5 —□— Konica 55Kg RECYCLED SHEET

P1 Xerox 20 Lbs SHEET

P2 Xerox 24 Lbs SHEET

P3 Konica 110 Kg SHEET

P4 Konica 55 Kg SHEET

P5 Konica 55Kg RECYCLED SHEET

IMAGE FORMING APPARATUS HAVING TRANSFER ROLLER AND SEPARATION BRUSH

BACKGROUND OF THE INVENTION

The present invention relates to an image forming apparatus such as an electrostatic copier, an electrostatic printer etc., in which an electrostatic transfer process and an electrostatic separation process are used, and specifically to an image forming apparatus in which a contact transfer means employing a transfer roller etc. and a separation means employing a separation brush etc. are used. Further, the present invention relates to a color image forming apparatus by which a color toner image is formed when two or more mono-color toner images are superimposed.

In an electrostatic copier or an electrostatic printer in which electrophotographic technology is used, conventionally a corona discharger is widely used for a charging/transfer/separation apparatus. However, there is a problem in that it is necessary that a corona discharger is impressed with a high voltage of 5 to 10 KV and ozone is produced when discharging. Accordingly, currently, substitute technology such as a contact charging method, a transfer roller method, or a separation brush method is noted in order to decrease a voltage and in order to avoid the production of ozone.

Currently, the transfer roller method or the separation brush method is used because the amount of ozone generation is small as compared with the conventional corona discharge transfer method and because uneven transfer caused by stains of the discharging wire etc. does not occur.

The prior art of the current/voltage control in the transfer roller method is disclosed in Japanese Patent Publication No. 33494/1977 (U.S. application Ser. No. 309562, Priority date Nov. 24, 1972), Japanese Patent Publication Open to Public Inspection Nos. 19456/1975, 45344/1977, and 123385/1990.

Further, the prior art of a discharging brush to discharge a transfer material is disclosed in Japanese Patent Publication Open to Public Inspection No. 91671/1990. The prior art of a discharging needle to separate the transfer material from the image carrier is disclosed in Japanese Patent Publication Open to Public Inspection Nos. 16879/1992 and 16880/1992.

On the other hand, conventionally, in the image carrier such as a photoreceptor drum, a photoreceptor belt or a dielectric drum, separation by the rigidity of the transfer material (a recording sheet etc.), (separation by the so-called small radius of curvature) can be conducted even when the separation means is not specifically provided, in the case where the diameter of the image carrier is smaller than 70 mm, or in the case where the radius of curvature in a transfer section or separation section is smaller than 35 mm.

However, in a color image forming apparatus in which each color toner image is superimposed on the photoreceptor drum, one toner image should be formed on the image carrier and the length of a circumference of the image carrier should be greater than the image length. Accordingly, the diameter of the photoreceptor drum is inevitably increased.

Generally, in order to transfer the toner image onto the sheet from the photoreceptor, the following operations are conducted. Transfer charges are applied to the rear sheet so that the transfer electric field is formed and the toner image is attracted from the photoreceptor to the sheet. In order to conduct the above, the amount of the transfer charge corresponding to that of the toner charge should be applied to the sheet. The transfer charge thus given to the sheet forms the electric field between the sheet and the photoreceptor, and inevitably acts as the adhesion force between the sheet and the photoreceptor. In order to separate the sheet from the photoreceptor by an electric means, a charge having the reverse polarity is given by a separation means so that the transfer charge is neutralized, until the sheet can be separated from the photoreceptor mainly by the rigidity of the sheet according to the radius of curvature of the photoreceptor. In this case, when an excessive charge is given, the toner which has been temporarily transferred on the sheet is returned to the photoreceptor, accordingly it is necessary that the neutralization is accurately conducted. When the radius of curvature of the photoreceptor is larger, the rigidity-energy or moment of the sheet is decreased. Accordingly, it is difficult to obtain good separability of the sheet.

Further, the thinner the thickness of the sheet is, the smaller the rigidity energy is. Accordingly, it is very difficult to obtain good separability of thin sheets. Specifically, when the radius of curvature of the photoreceptor is larger than 35 mm, it is very difficult that both of the transfer and separation, are satisfied by the above conditions in all circumstances and transfer sheet.

This is due to the reason in which the neutralization condition (discharging condition) of the transfer charge, by which the sheet can be separated from the photoreceptor, is realized only in an extremely narrow range. In order to overcome these difficulties, the following are important: the discharging condition of the separation means for separating the transfer sheet corresponding to the supplied transfer charge is appropriately set; and setting of the separation bias voltage is adjusted corresponding to the environmental conditions.

Generally, the rigidity energy, U, of the sheet in the case where the sheet is wound around the drum having the radius of curvature of R, is expressed by the following equation:

$$U=Gd^3\ bl/24R^2.$$

Where,

R=the radius of curvature of the photoreceptor b=297 mm (the width of the sheet)

l=50 mm (the length of the wound portion of the sheet)

G=the modulus of longitudinal elasticity d=the thickness of the sheet

Electric energy, in the case where the sheet is adhered to the photoreceptor by the residual charge after the sheet has been passed through the separation means, is increased as the potential difference ΔV between the surface potential of the rear of the sheet and that of the photoreceptor is increased. Accordingly, the potential difference ΔV expresses the degree of the neutralization of the charge.

Quantitative test data of the radius of curvature of the drum and and separability of the sheet is shown in the following table in which the test data is expressed by the rigidity energy of the sheet and the potential difference ΔV between the surface potential at the rear of the separable sheet and that of the photoreceptor.

TABLE A

| Types of sheets | Radius of curvature of the photoreceptor (mm) | Rigidity-energy of sheet (mJ) | ΔV/V |
|---|---|---|---|
| Konica 45 kg | 50 | 0.28–0.53 | 100 |
| | 35 | 0.58–1.10 | 300 |
| | 25 | 1.14–2.15 | more than 1000 |
| Konica 55 kg | 50 | 0.46–0.87 | 300 |
| | 35 | 0.94–1.79 | more than 1000 |
| | 25 | 1.84–3.50 | more than 1000 |
| Konica 70 kg | 50 | 0.76–1.40 | more than 1000 |
| | 35 | 1.56–2.85 | more than 1000 |
| | 25 | 3.06–5.60 | more than 1000 |
| Konica 110 kg | 50 | 0.80–2.50 | more than 1000 |
| | 35 | 1.63–5.10 | more than 1000 |
| | 25 | 3.20–10.0 | more than 1000 |

The layer thickness of the organic photoreceptor (OPC) used in this separability test is 20 μm, and the potential voltage of the photoreceptor is −750 V.

The photoreceptor used in this test is composed as follows: an intermediate layer, a carrier generation layer and a carrier transport layer, which are shown in the following, are formed on an aluminum base body.

| [Intermediate layer] | |
|---|---|
| Polyamide resin (CN8000, made by Toyo Rayon Co.) and | 60 g |
| methanol | 2000 ml |

are mixed and dissolved, and an intermediate layer coating solution is prepared. This coating solution is coated on an aluminum base body by a dip coating method, dried by room temperature, and the intermediate layer having the film thickness of 0.3 μm is formed.

| [Carrier generation layer] | |
|---|---|
| Carrier generation material (C1, refer to FIG. 23(A)) (Titanyl phthalocyanine having an X-ray diffraction spectrum shown in FIG. 23(B)) | 60 g |
| silicone resin solution (KR5240, 15% xylene-buthanol solution, made by Shin-etsu Chemical Co.) and | 700 g |
| methyl ethyl ketone | 2000 ml |

are mixed, and dispersed for 10 hours using a sand mill, and a carrier generation layer coating liquid is prepared. This coating liquid is coated on the intermediate layer by dip-coating and a carrier generation layer having the film thickness of 0.2 μm is formed.

| [Carrier transport layer] | |
|---|---|
| [Carrier transport material] (D1, refer to FIG. 23(C)) | 200 g, |
| bisphenol Z type polycarbonate (Iupilon Z300, made by Mitsubishi Gas Chemical Co.), and | 300 g |
| 1,2 dichloroethane | 2000 ml |

are mixed and dissolved, and a carrier transport layer coating liquid is prepared. This coating liquid is coated on the carrier generation layer by the dip coating method, and the carrier transport layer, the film thickness of which is 20 μm, is formed.

Further, in such a color image forming apparatus, because the adhesion amount of toner for the superimposed colors on the photoreceptor drum is larger than that for the mono-color, it is difficult to obtain separability while maintaining good transfer characteristics of both of the superimposed colors and mono-color.

The following operations are conducted by the discharging means using a corona discharger. The discharging means impresses mainly the bias voltages with the reverse polarity, upon the recording sheet so that discharge is conducted. The charge given to the recording sheet at the time of transfer is neutralized and discharged. An electrostatic attraction function of the recording sheet to the photoreceptor is decreased by the discharge and the recording sheet is separated from the photoreceptor by the rigidity and weight of the recording sheet itself.

In this case, when the bias voltage is too low, the recording sheet is not separated from the photoreceptor. On the contrary, when the bias voltage is too high, the following problems occur. The discharge amount to the recording sheet becomes large and the rear surface of the recording sheet is charged with the same polarity as that of the toner. Accordingly, the toner on the recording sheet is scattered by the electrostatic repulsive force and so-called white streaks occur, or the toner is attracted to other components by the electrostatic attraction force and jamming occurs. Therefore, the bias voltage which is within an extremely limited range is set at a predetermined separation distance.

However, in the separation means provided with the discharging means described above, even when the bias voltage is set within an appropriate range, it is difficult to fully adjust the separation distance from the photoreceptor. Accordingly, in this case, inferior separation occurs and jamming is caused.

The transfer apparatus is provided close to the separation apparatus, and is charged with the reverse polarity to that of the separation apparatus. Accordingly, electric leakage tends to occur, and white streaks caused by the inferior transfer and jamming caused by the inferior separation occur. Further, the electric leakage to components other than the transfer apparatus near the separation apparatus is not fully prevented.

The discharge amount to the recording sheet is changed also by flapping of the recording sheet at the separation portion and white streaks occur, and the leading edge of the recording sheet is caught by the separation unit, so that jamming occurs.

SUMMARY OF THE INVENTION

The object of the present invention is to attain the following objects and to provide an image forming apparatus in which the stable and good transfer property and separability are obtained.

(1) To contrive the coexistence of good transfer property and separability in the image forming apparatus in which a drum-shaped image carrier, whose diameter is larger than 70 mm, or a belt-shaped image carrier whose radius of curvature is larger than 35 mm at least at a transfer portion or a separation portion is used, and to expand the allowable range in order to control the separation bias voltage, that is, to easily set the separation bias voltage effective for various types of transfer sheets.

(2) To contrive the coexistence of transfer property and separability in a process in which each toner image is superimposed on the image carrier, and to form a good color image on the transfer material.

(3) To obtain a high quality transfer image without white streaks caused by uneven transfer or image repelling at the separation section.

(4) To provide a process in which ozone is not generated and nitride is not formed according to a high voltage discharge, and in which the photoreceptor is not deteriorated and the image quality is not lowered.

(5) To keep separation stability, and to keep good transfer property and separability of both of a mono-color and superimposed colors.

(6) To always keep the separation stability even in variations of the environmental temperature and humidity, and to obtain a high quality transfer image without image repelling at the separation section.

(7) To always keep the separation stability for various kinds of transfer sheets having different sheet quality, and to obtain the high quality transfer image.

Further, an object of the present invention is to avoid the influence of electric leakage and flapping by which jamming or white streaks are caused, and to provide a transfer sheet separation apparatus of the image forming apparatus in which separation performance can be maintained even when the bias voltage is out of the specified range.

In order to attain the above objects, the first embodiment of an image forming apparatus of the present invention is structured as follows. The image forming apparatus comprises: a drum-shaped image carrier whose diameter is larger than 70 mm, or a belt-shaped image carrier whose radius of curvature is larger than 35 mm at least at the transfer portion or separation portion; a charging means for uniformly charging the image carrier; an exposure means for forming an electrostatic latent image on the image carrier; a developing means for developing the electrostatic latent image to obtain a toner image; a transfer means for electrostatically transferring the toner image onto a transfer material; and a separation means for separating the transfer material, on which the toner image has been transferred, from the surface of the image carrier. The separation means has at least a means for electrostatically separating the transfer material by a variable DC current or a bias current composed of the variable DC current and an AC component. Also, a power source by which the transfer means is constant-current-controlled at the time when the transfer material passes through a transfer portion formed between the image carrier and the transfer means, is provided in the apparatus.

Further, in the image forming apparatus structured as described above, it is desirable that the appropriate ranges of the transfer current and separation voltage are obtained from the following conditions:

Overall environment:
- transfer current = (40 nC/cm$^2$ − 200 nC/cm$^2$)
  - × (the circumference speed of the photoreceptor (cm/s))
  - × (the width of the transfer roller (cm))
- separation DC bias voltage = +4.0 to −4.0 KV LL:
- transfer current = (40 nC/cm$^2$ − 180 nC/cm$^2$)
  - × (the circumference speed of the photoreceptor (cm/s))
  - × (the width of the roller (cm))
- separation DC bias voltage = +4.0 to −2.0 KV HH:
- transfer current = (60 nC/cm$^2$ − 200 nC/cm$^2$)
  - × (the circumference speed of the photoreceptor (cm/s))
  - × (the width of the roller (cm))
- separation DC bias voltage = +2.0 to −4.0 KV where LL expresses the low temperature and low humidity environment, and HH expresses the high temperature and high humidity environment.

In order to attain the above objects, the second embodiment of the image forming apparatus of the present invention is structured as follows. In the image forming apparatus, the following operations are conducted: the electrostatic latent image formed on the image carrier is developed by a charged toner in the developing means and a toner image is formed; the toner image is electrostatically transferred onto the transfer material which has been fed from a sheet feed section and passes between the image carrier and the transfer means; and the transfer material having the toner image thereon is separated from the image carrier by a separation means located downstream of the transfer means. A temperature detection means and/or a humidity detection means are provided in a casing of the image forming apparatus, and send environmental temperature and humidity detection signals to a control means. The control means controls a variable DC component of a separation voltage of the separation means, ranging from a positive polarity to a negative polarity.

The third embodiment of the image forming apparatus of the present invention is structured as follows. In the image forming apparatus, a detection means for detecting an electric resistance of the transfer material is provided at a transfer material conveyance path; a value of the electric resistance detected by the detection means is sent to the control means; and the variable DC component of the separation voltage of the separation means is controlled by the control means ranging from a positive polarity to a negative polarity. There is an occasional case where the power source for the positive polarity and that of the negative polarity are prepared and power source is switched corresponding to the control signal because the control range of the separation voltage ranges from a positive polarity to a negative polarity.

The fourth embodiment of the present invention is structured as follows. The image forming apparatus is provided with a separation apparatus by which the separation bias voltage is impressed upon the transfer material so that the transfer material can be separated after the toner image formed on the drum-shaped image carrier whose diameter is larger than 70 mm, or the image carrier whose radius of curvature is larger than 35 mm at the transfer portion or at the separation portion, has been transferred onto the transfer material by the transfer means. The image forming apparatus is provided with an insulation shielding means made of insulation material which is structured as follows. The insulation shielding means surrounds the separation apparatus; the insulation material crosses over between the front and rear walls of the insulation shielding means while the opening surface remains between the separation apparatus and the image carrier in the conveyance direction of the transfer sheet, and all of other surfaces are coated by insulation material.

Here, the image forming apparatus can be structured as follows. Both side portions of the insulation shielding means come into contact with the image carrier, and an intermediate portion of the insulation shielding means approaches the image carrier. The separation distance between the separation apparatus and the image carrier is regulated.

Further, the insulation shielding means may be provided with insulation rollers which are rotatably supported by both side portions of the insulation shielding means, and the insulation shielding means comes into contact with the image carrier through the rollers.

Further, the apparatus can also be structured as follows. The insulation shielding means is provided with an insulation conveyance guide for the transfer material which is formed at a tilting downward angle in the downstream side of the conveyance direction of the transfer material of the separation apparatus.

Further, the insulation conveyance guide may be structured so that the top of the guiding wall for the transfer material is formed to have unevenness in the direction perpendicular to the conveyance direction of the transfer material.

Further, the separation apparatus may also be structured in such a manner that a pointed electrode or a conductive brush can be used as the separation electrode.

Further, the image carrier may be structured in the manner that more than two color toner images can be formed thereon.

Further, the image forming apparatus may be structured in the manner that a non-contact two-component reversal developing means by which the DC component potential voltage and the AC component potential voltage are superimposed on the developing area on which the image carrier conveys the two-component developer, is provided in the apparatus.

Further, the transfer means may be structured by a transfer roller or a transfer brush.

By the transfer material separation means structured as described above, the following can be prevented. Because the entire surface of the separation apparatus except the opposite surface to the image carrier is insulation-coated by the insulation shielding means, the electrical leakage to not only the transfer unit but also other peripheral components can be prevented. In addition to the above, the insulation material crosses over to the opposite surface to the image carrier, and therefore, the transfer material is not caught by the separation apparatus and jamming can be prevented even when flapping of the transfer sheet occurs.

Further, in the image forming apparatus in which the separation distance from the image carrier is regulated when both side portions of the insulation shielding means come into contact with the image carrier, the separability by the bias voltage can be maintained. Further, because a gap between the intermediate portion of the insulation shielding means and the image carrier can be very small, electric leakage to the transfer unit, which has a great influence on image formation, can be greatly decreased.

Further, in the image forming apparatus in which both side portions of the insulation shielding means come into contact with the image carrier through insulation rollers, the apparatus can be smoothly operated without catching the transfer material, and the rollers are not worn by long periods of use, so that a predetermined separation distance can be maintained.

Further, in the image forming apparatus in which the insulation shielding means is provided with the conveyance guide which is angled downward, the leading edge of the separated transfer material is rapidly guided downward by its weight and rigidity and is not affected by the image carrier, so that the transfer sheet can be easily separated from the image carrier and the separability can be improved.

Further, in the image forming apparatus in which the insulation shielding means is provided with the insulation conveyance guide having unevenness, the transfer sheet can be more smoothly conveyed when the friction force is decreased by reducing the contact surface of the transfer material with the conveyance guide.

Further, the separation apparatus can also be applied to the image forming apparatus, in which a pointed electrode or conductive brush is used as the separation electrode, or the transfer roller or transfer brush is used as the transfer means, or which has the image carrier on which more than two color toner images can be formed or the non-contact two-component reversal developing means.

DETAILED DESCRIPTION OF THE PREFERRED EMBODIMENT

Figure 1:
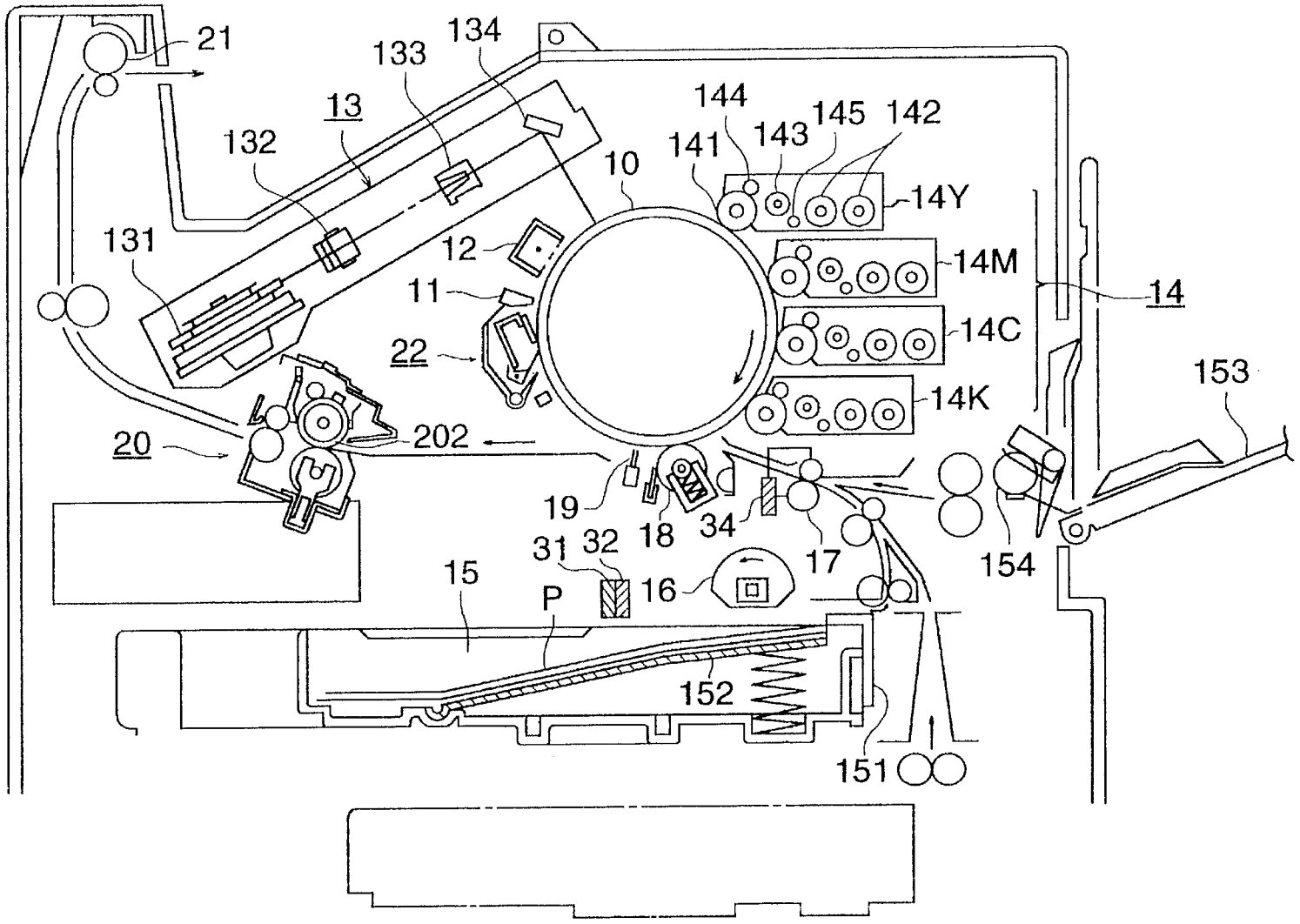
FIG. 1 is a sectional view showing a structure of a color printer as an example of an image forming apparatus of the present invention.

Referring to FIG. 1, the construction and operation of a color printer which is an example of an image forming apparatus of the present invention will be described prior to the explanation of the embodiments of the present invention.

This color printer is one of a color image forming apparatus in which: color toner images successively formed are superimposed on the image carrier; then a color image is formed when toner images are transferred onto a recording sheet all at once at a transfer section, and after that, the recording sheet is peeled off from the surface of the image carrier by a separation means.

In the drawings, numeral 10 is a photoreceptor drum that is an image carrier. The photoreceptor drum 10 is coated thereon with an OPC photoreceptor (organic photoreceptor) and rotated clockwise. In this case, the photoreceptor drum 10 is connected to earth. Numeral 12 is a scorotron charger. The circumferential surface of the photoreceptor drum 10 is given a uniform charge of $V_H$ by the scorotron charger 10, the grid of which is maintained at the electric potential of $V_G$, wherein corona charging is conducted by the grid and corona discharge wire of the scorotron charger 12. Before electric charging is conducted by the scorotron charger 12, the circumferential surface of the photoreceptor drum is electrically discharged when the circumferential surface is exposed to light emitted by PCL11 (pre-charging discharger) in which light emitting diodes are used. This discharging operation is conducted for erasing the hysteresis of the photoreceptor.

After the photoreceptor has been uniformly charged, image exposure is conducted by the image exposure means 13 in accordance with image signals. The image exposure means 13 includes a light source (not shown) in which a laser diode is used, rotational polygonal mirror 131, fθ lens 132, cylindrical lens 133, and reflection mirrors 132. A beam of light emitted by the light source passes through the polygonal mirror 131, fθ lens 132 and cylindrical lens 133. Then an optical path of the beam of light is bent by the reflection mirrors 134, so that primary scanning is conducted, and a latent image is formed on the photoreceptor drum 10 when it is rotated (subsidiary scanning). In this example, exposure is conducted on the character section, so that the electric potential of the character section becomes a low potential of $V_L$. In this way, a reversal latent image is formed.

Around the photoreceptor drum 10, there are provided developing units 14 (14Y, 14M, 14C, 14K) respectively including developer composed of carrier and toners of Yellow (Y), magenta (M), cyan (C) and black (K). First of all, development of the first color, yellow, is conducted by the developing sleeve 141 which includes a magnet and rotates while developer is held on its circumferential surface. Developer includes: carrier particles, the cores of which are made of ferrite, and the cores are coated with insulating resin; and toner particles mainly made of polyester, to which pigment, charging control agent, silica and titanium oxide are added. A layer of developer formed on the developing sleeve 141 is regulated by a layer forming means, so that the thickness of the developer layer is controlled to be 100 to 600 μm. By the developing sleeve 141, developer is conveyed to the developing region.

In the developing region, a gap formed between the developing sleeve 141 and photoreceptor drum 10 is larger than the layer thickness of developer, that is, the gap is formed to be 0.2 to 1.0 mm. A bias in which an AC bias of $V_{AC}$ and a DC bias of $V_{DC}$ are superimposed, is impressed in the gap. In this case, the polarities of $V_{DC}$, $V_H$ and toner are the same. Therefore, toner particles which are released from carrier particles by the action of $V_{AC}$, are not deposited on a portion of $V_H$, the electric potential of which is higher than $V_{DC}$, but deposited on a portion of $V_L$, the electric potential of which is lower than $V_{DC}$. In this way, the latent image is made to be visual, that is, reversal development is conducted.

After the first color image has been made to be visual, the image formation process of the second color, magenta, is started. Therefore, the photoreceptor drum is uniformly charged by the scorotron charger again, and then a latent image is formed by the image exposure means in accordance with the second color image data. At this time, discharging operation is not conducted by PCL11 in order to prevent the toner particles of the first color deposited on the image portion from scattering. Because the toner particles of the first color are scattered when the electric potential is suddenly lowered.

In this way, the overall circumferential surface of the photoreceptor drum 10 is charged to the potential of $V_H$. In a portion on the circumferential surface of the photoreceptor drum 10 where the first color image is not formed, the same latent image as that of the first color is formed and developed. In a portion where the first color image exists and development is conducted again, a latent image of $V_M$ is formed by the action of exposure light which is shielded by the toner of the first color and also by the action of an electric charge of toner. Accordingly, development is conducted in accordance with a potential difference between $V_{DC}$ and $V_M$. When the first color development is conducted on a latent image of $V_L$ in the region where the first and second color images are superimposed, the first and second colors become unbalanced. For this reason, an amount of exposure of the first color is reduced so that an intermediate potential satisfying the following inequality can be obtained.

$$V_H > V_M > V_L$$

With respect to the third color, cyan, and fourth color, black, the same image formation process as that of the first color is carried out, and a visual image of four colors can be formed on the circumferential surface of the photoreceptor drum 10.

A sheet of transfer material (a recording sheet P) conveyed out from the sheet feed cassette 15 by the semicircular roller 16, temporarily stops at a position close to the sheet feed roller 17. The recording sheet P is conveyed to the transfer region by the sheet feed roller 17 in a timed relation of transfer.

In the transfer region, the transfer roller 18 comes into pressure contact with the circumferential surface of the photoreceptor drum 10 in a timed relation of transfer, so that the recording sheet P is interposed between the photoreceptor drum 10 and the transfer roller 18, and a multi-color image can be transferred all at once.

Next, the recording sheet P is electrically discharged by the separation brush 19 which has come into pressure contact with the photoreceptor surface. Therefore, the recording sheet P is separated from the circumferential surface of the photoreceptor drum 10 and conveyed to the fixing unit 20. Toner on the recording sheet P is heated by the heat roller (upper roller) 201 and pressed by the pressure roller (lower roller) 202. After that, the recording sheet P is discharged outside the apparatus. In this connection, the transfer roller 18 and separation brush 19 are withdrawn and separated from the circumferential surface of the photoreceptor drum 10 in order to prepare for the next image formation.

After the recording sheet P has been separated from the circumferential surface, the blade 221 of the cleaning unit 22 comes into pressure contact with the photoreceptor drum 10, so that residual toner is removed and cleaned. After that, the photoreceptor drum 10 is discharged by PCL11 and charged by the charger 12. Then the next image formation process is started. In this connection, after the circumferential surface of the photoreceptor has been cleaned, the blade 221 is immediately moved and withdrawn from the circumferential surface of the photoreceptor drum 10.

Features of functions and performance of units, of which the image forming section of the apparatus is composed, will be described below.

(Photoreceptor)

Since the photoreceptor drum 10 can be stably rotated as described above, the OPC photoreceptor on the circumferential surface of the photoreceptor drum 10 can be uniformly charged by the scorotron charger 12. In the process of charging, the grid voltage is controlled, so that the charging voltage can be stabilized. One example of the specification of the photoreceptor and the charging condition will be described as follows. Specifically, the following OPC is preferable. An OPC using Y-type titanyl phthatocyanine or polycrystalline-type titanyl phthalocyanine disclosed in Japanese Patent Publication Open to Public Inspection Nos. 17066/1989, 183258/1990, 183265/1990 and 128973/1991.

Photoreceptor: OPC $\phi$120, line speed 100 mm/sec, negatively charged; this is the photoreceptor described in page 6, which is used for the separability test.

Charging conditions: a charging wire: a platinum wire (clad or alloy) is preferably used. $V_H$- 850 V, $V_L$ - 50 V (Image Exposure)

After the OPC photoreceptor on the peripheral surface of the photoreceptor drum 10 has been negatively charged by the charger 12, the photoreceptor is exposed by light emission of the semiconductor laser unit 135 of the exposure means 13 and the electrostatic latent image is formed.

Image data sent from a formatter for decoding a printer command is sent to a laser diode (LD) modulation circuit. When the LD of the semiconductor laser unit 135 emits the laser beam by a modulated image signal, the light beam is projected onto a polygonal mirror 131 when scanning lines are synchronized with each other by a beam index.

The light beam is reflected by the polygonal surfaces of the polygonal mirror 131 so that scanning is conducted. A beam configuration of the scanning light is corrected by the f$\theta$ lens 132 and the cylindrical lens 133. Then the scanning light conducts primary scanning on the photoreceptor through the reflection mirror 134. In this way, an electrostatic latent image is formed.

The laser beam is concentrated to 600 DPI by the optical system. Consequently, in order to provide an image of high quality, it is necessary to reduce the toner particle size. In this example, the toner particle size of each color is 8 μm. In this case, the quality of black characters is most important for users. Therefore, black toner particles of small size (7 μm to 11 μm) are preferably used.

An example of the construction of the optical system of image exposure is shown as follows.

Polygonal mirror: 6 faces, rotational speed 23600 rpm An air bearing is employed.

Focal distance of the lens: f=140 mm

Dot clock: 20 $MH_z$

Beam diameter: about 60×80 μm (Development)

Toner supplied from the toner box is dropped to a right end of the developing unit, and then toner and carrier are stirred and mixed by a pair of stirring screws 142 which are rotated in the opposite direction, so that a predetermined charging amount (Q/M) can be set.

Toner concentration is detected by the permeability detection method (the L-detection system). In accordance with the output frequency of detection, an amount of toner supply is controlled so that the toner concentration can be 5 to 7%.

The stirred two component developer is conveyed to the development sleeve 141 through the supply roller 143. Then the thickness of the developer layer is made to be thin by the layer thickness regulating member 144. After that, the developer layer is sent to the developing region of the photoreceptor drum 10. Then the reversal development of the electrostatic latent image is conducted under the following developing conditions. In this developing system, the development is conducted under the condition that bristles of developer are not contacted with the drum. Non-contact two-component reversal development is conducted by the developing electric field in which the AC component is superimposed on the DC component.

Development gap: 0.5 mm

Amount of conveyed toner: 20 to 30 mg/cm$^2$

Development bias (AC): 2 KV, 8 KHz

Development bias (DC): −750 V

Rotational direction of developing sleeve: Normal direction with respect to photoreceptor drum Adjustment of image density: Rotational speed control of developing sleeve or control of developing bias (A reference board is formed on the photoreceptor by a laser beam. After development, the reflection density is measured and the image density is adjusted.)

Control of toner concentration: L detection system (Sheet Feeding)

Recording sheets P are accommodated in the sheet feed cassette 15, wherein one side of the recording sheets P is aligned along a reference surface. Consequently, a separation claw 151 is provided only on the reference surface side of the recording sheets P. A semicircular roller 16 is supported in the manner of a cantilever manner and disposed on the reference surface side of the recording sheets P.

The sheet feeding section is provided with an exclusive motor. The semicircular roller 16 is rotated in the arrowed direction, and only the uppermost recording sheet P on a pushup board 152 is conveyed by the action of the separation claw 151.

The recording sheet P conveyed out from the sheet cassette 15 is sent to the conveyance passage, and the conveying direction is changed. Immediately after the fore end of the recording sheet has passed through the sheet feed roller 17, the motor is temporarily stopped by a signal sent from a sheet sensor not shown in the drawing. After the transfer timing has been adjusted, the motor is started again, so that the recording sheet P is fed to the transfer region while a predetermined angle is formed between the recording sheet P and the photoreceptor surface.

When the recording sheets P are fed by means of manual-feed, the manual-feed tray 153 is set at a position illustrated by a solid line in FIG. 1.

The recording sheet P is conveyed from the manual-feed tray 153 when the pickup roller 154 is rotated, and conveyed to the transfer region via the register roller 17.

Types of sheets subjected to manual-feeding are usual recording sheets P of 16 Lbs to 24 Lbs. Further, thick sheets of 36 Lbs and transparent sheets used for OHP are applied to manual-feeding. The manual-feed tray 153 may be removed, and an optional feeder may be attached to the apparatus so that envelopes can be fed.

(Transfer)

Figure 2:
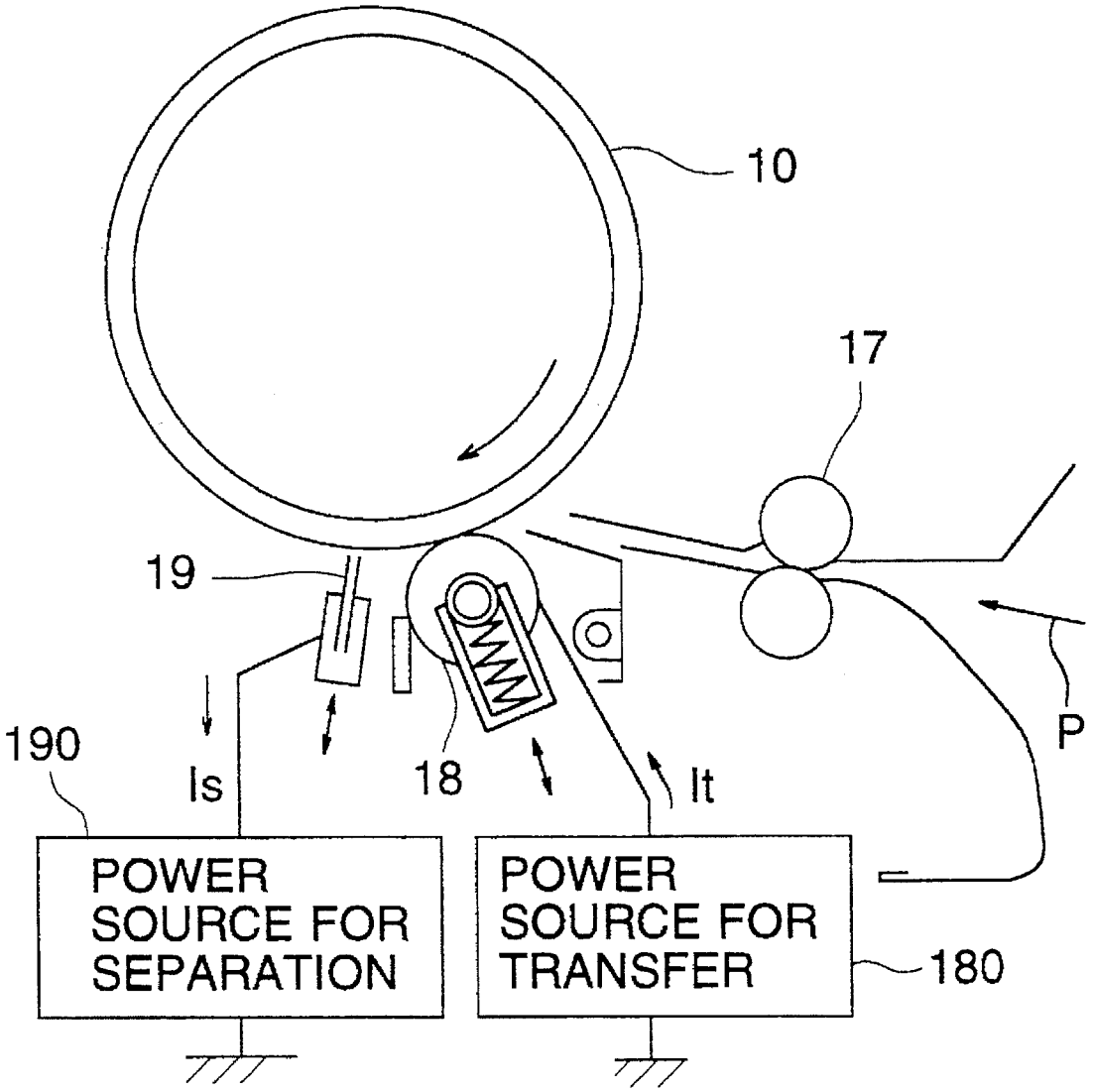
FIG. 2 is a primary sectional view of the transfer section.

The position of the transfer roller 18 can be changed with respect to the circumferential surface of the photoreceptor drum 10. In the case where a mono-color image is formed, the transfer roller 18 comes into pressure contact with the circumferential surface of the photoreceptor drum 10 at all times as shown in FIG. 2. During the process of color image formation, the transfer roller 18 is withdrawn, and only when the transfer operation is conducted, the transfer roller 18 comes into pressure contact with the circumferential surface of the photoreceptor drum 10.

In this case, the pressure is preferably 50 to 1000 g/cm as the force per unit length of the roller, and the nip width under the pressure contact condition is preferably 0.5 to 5 mm. On the other hand, the separation brush 19 is also contacted with and withdrawn from the circumferential surface of the photoreceptor drum 10 synchronously with the transfer roller 18.

In this example, the transfer roller 18, upon which a voltage of +3 KV DC to +4 KV DC is impressed from a power source 180 for transfer, and the surface of which is cleaned by a cleaning blade, is used for the apparatus and a power source 190 for separation by which a bias voltage, in which variable DC and AC voltage are superimposed, is impressed upon the separation brush 19 is used for the apparatus. Furthermore, the power source 180 for transfer by which a bias voltage, in which a variable DC and an AC voltage are superimposed, is impressed upon the transfer roller 18 may be used for the apparatus.

(Fixing)

Figure 3:
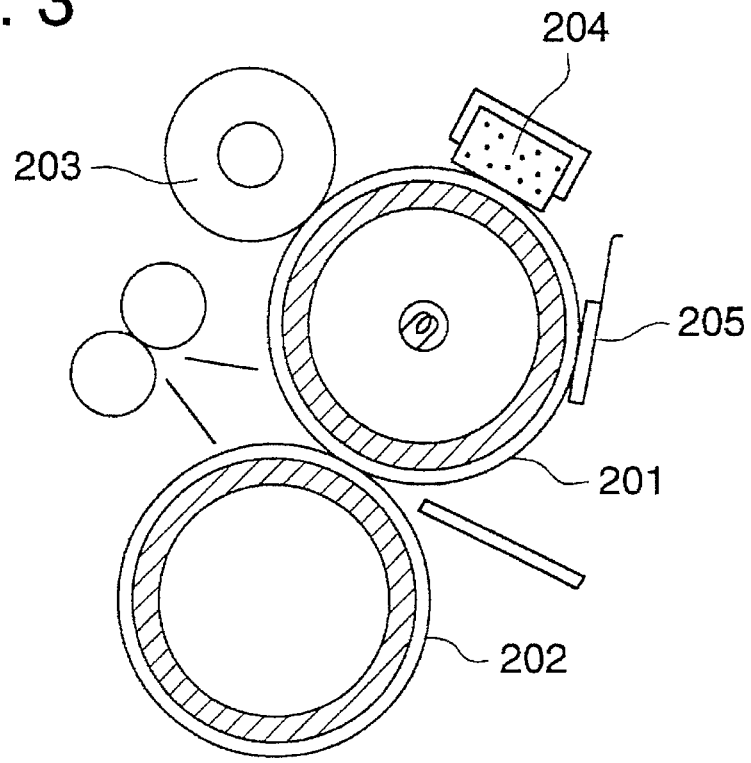
FIG. 3 is a primary sectional view of a fixing unit.

As illustrated in FIG. 3, the fixing unit 20 of this example is a heat-roller type fixing unit composed of a pair of rollers. In the upper roller 201, the heater H is assembled, and the upper roller 201 is rotated clockwise. The lower roller 202 is idly rotated coming into pressure contact with the upper roller 201. The recording sheet P is held by the nip portion formed by the upper and lower rollers. In this way, the recording sheet P is heated so that the toner image can be fused.

Both upper and lower rollers 201 and 202 are covered with a heat resistant tube. By the upper and lower rollers, a linear nip portion is formed, so that the occurrence of wrinkles can be prevented in the case where envelopes are conveyed.

The temperature on the circumferential surface of the upper roller 201 is controlled when it is detected by the temperature sensor 205 such as a thermistor, so that the temperature can be maintained in a predetermined temperature range. When a cleaning roller 203 comes into pressure contact with the upper roller 201, stains of toner can be removed. When 40000 sheets are printed, the cleaning roller is replaced with a new one. When the fixing heater is not used exceeding a predetermined period of time, the fixing heater is set in the SLEEP MODE, so that electric power can be saved.

In the case where transparent sheets used for over-head projector (OHP) are applied, in order to enhance the transmission factor, it is necessary to make the toner image surface smooth so as to prevent irregular reflection. For this reason, the surface of the upper roller 201 is coated with silicon oil by an oil pad 204 provided on the circumferential surface.

In the apparatus of this example, the conveyance speed of transfer sheets can be switched to 3 steps of 100, 50, 12.5 m/sec, so that 3 types of transfer sheets, which are regular sheets, envelopes and transparent sheets, can be applied to the apparatus.

In this connection, when a toner, the fusing temperature of which is low, is used, the setting temperature of the upper roller 201 can be lowered to about 180° C. When sponge material (coated with porous PTFE) is used for the oil pad 204, the upper roller 201 is uniformly pressed by the oil pad 204, so that oil can be uniformly coated.

(Transfer Roller)

Next, the structure of the foregoing transfer roller 18 will be explained.

Figure 4:
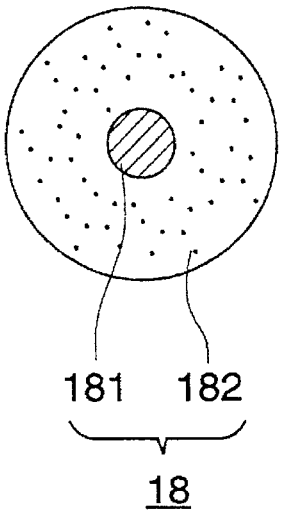
FIGS. 4(A), 4(B), and 4(C) are sectional views of various kinds of transfer rollers.
Figure 4:
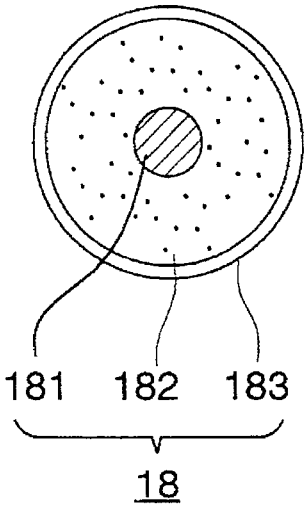
Figure 4:
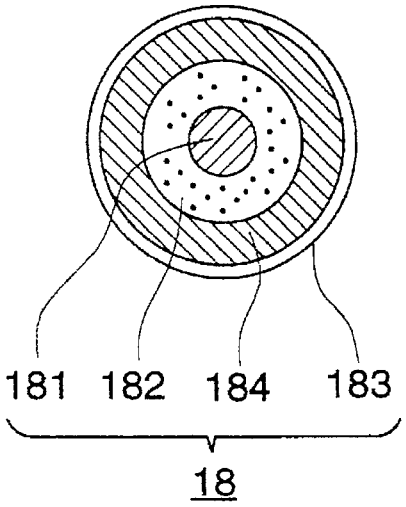

FIG. 4(A) is a sectional view of the mono-layer type transfer roller 18. In the drawing, the transfer roller is structured as follows. The transfer roller is composed of a shaft body (core bar) 181, and resin material such as polyurethane rubber, silicone rubber, styrene butadiene copolymer elastomer, and orefin elastomer is formed on the outer periphery of the shaft body by the foam type method or continuous foam type method using 10 to 100 μm cell size. Further, the transfer roller is composed of a conductive elastic portion 182 to which electric charges can be given and in which inorganic and/or organic conductive agent such as carbon black is mixed into the resin material as an electric conductivity adding agent. In this case, polyurethane resin (rubycell roller made by Nitto Kogyo Co.) is used as the elastic portion 182.

FIG. 4(B) is a sectional view showing the coated transfer roller 18.

This transfer roller 18 is structured as follows. The surface coating layer portion 183 made of polyvinylidene fluoride (PVDF), polyamide 6 (nylon 6), polyamide 66 (nylon 66), polyethylene terephthalate (PET), and per fluoro acrylate resin (PFA), the film, in thickness of 5 to 100 μm, is provided on the outer peripheral surface of the elastic portion 182 of the mono-layer type transfer roller. By this coating layer portion 183, the surface of the transfer roller 18 can be easily and effectively cleaned and maintenance operation can be improved.

FIG. 4(C) is a sectional view of another example of the coating type transfer roller 18.

This transfer roller 18 is structured as follows. An intermediate resistance layer portion 184 is provided on the outer layer of the elastic portion 182 provided on the outer peripheral surface of the shaft body 181, and the foregoing coating layer portion 183 is formed on the outer peripheral surface of the intermediate resistance layer portion. Material which can optimize the electrical resistance can be selected as the intermediate resistance layer portion 184. From this material, this transfer roller can be structured to be a function separation type in which the elastic portion 182 is provided with a predetermined elasticity, and the intermediate resistance layer portion 184 is provided with a predetermined conductivity adding property. The electric resistance is measured as follows. For example, both ends of the roller shaft are respectively pressed onto the aluminum conductive plate by a force of 500 gf and the electric resistance (Ω) of the conductive plate and the roller shaft is measured. This resistance value can be converted into a value expressed by Ω·cm using the total layer thickness of the elastic layer and coating layer and the formed nip area.

The electric resistance value of the transfer roller 18 is preferably $10^2$ Ω·cm to $10^{10}$ Ω·cm.

The hardness of the rubber transfer roller 18 is preferably lower than 60° (Asker-C scale hardness stipulated by JIS-K6301) when measured by a rubber hardness meter.

Transferring by the transfer roller 18 is conducted as follows. The transfer roller 18 is directly contacted with the rear surface of the recording sheet P, toner is pressure-contacted with the roller, voltage whose polarity is reverse to that of toner is impressed upon the transfer roller 18, and transfer is conducted.

(Separation Means)

The recording sheet can be separated from the photoreceptor only by its rigidity due to the small radius of curvature at the separation portion in the belt photoreceptor or the drum photoreceptor having a small diameter. However, this separation is limited by the shape of the photoreceptor. In high speed apparatus or the like, stable high speed separation can be attained when the AC discharging separation is adopted in the apparatus together with this separation. The AC discharging separation is conducted as follows. The recording sheet is discharged by an AC corona voltage or a high AC voltage just after transfer so that the electrostatic attraction force of the recording sheet to the photoreceptor is reduced, and the recording sheet is separated using its rigidity and weight. However, when the AC discharge is too strong, inferior transfer such as white streaks (blank areas) tend to occur. When the AC discharge is too weak, separation is difficult when the recording sheet is thin and whose rigidity factor is small. Accordingly, it is necessary that a well-balanced discharging amount is set considering the types of sheets and other pertinent circumstances. Examples of the separation means using the high voltage AC discharge are shown in FIGS. 5(A) to 5(E).

Figure 5:
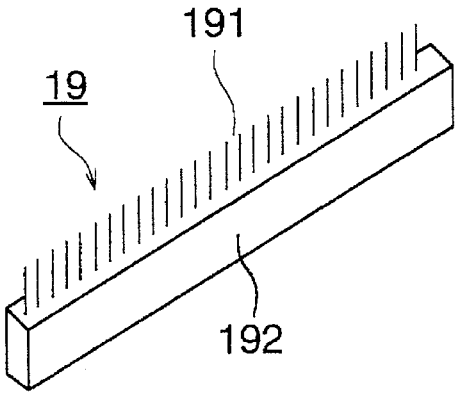
FIGS. 5(A) to 5(F) are perspective views of various kinds of separation means.
Figure 5:
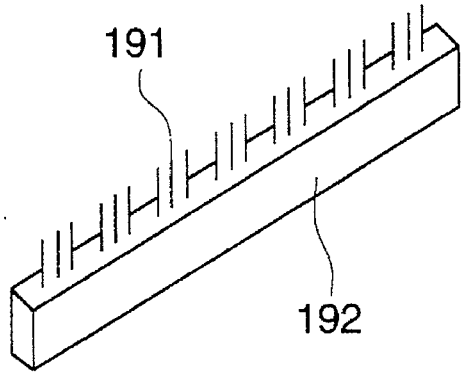
Figure 5:
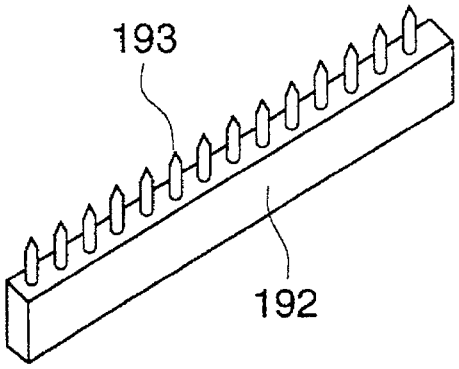
Figure 5:
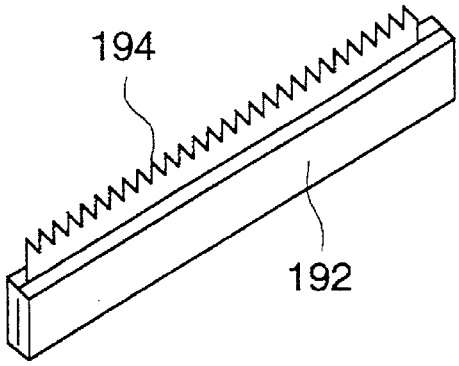
Figure 5:
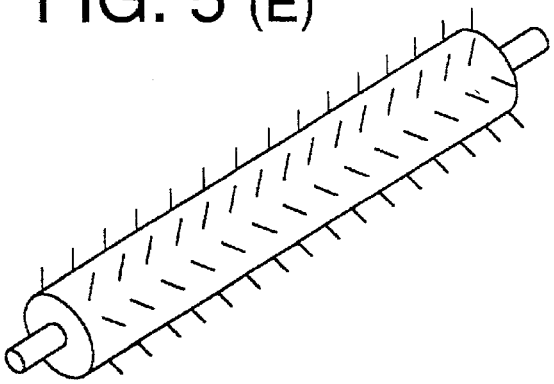
Figure 5:
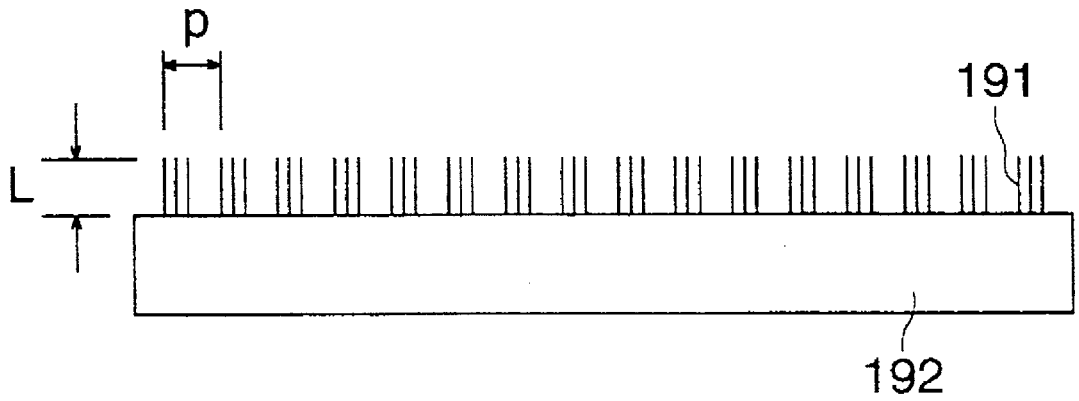

FIGS. 5(A) and 5(B) are perspective views of a separation brush 19 in which a metallic wire 191 made of a stainless steel wire or aluminum wire is arranged in a holding member 192 in a row or plural rows. FIG. 5(A) shows a closely arranged type, and FIG. 5(B) shows a coarsely arranged type. The diameter of the metallic wire 191 (filament) is 0.01 to 0.1 mm and the protrusion of the metallic wire from the holding member 192 is 3 to 5 mm. Good results can be obtained as effects of the separation from the coarsely arranged type shown in FIG. 5(B) in which bundles of metallic wires 191 are arranged in a respective distance of 2 to 5 mm. Here, instead of the metallic wires 191, a separation brush using a thread of rayon on which a conductivity adding agent is coated, may also be used.

FIG. 5(C) shows a separation brush in which metallic needles 193 having small spherical shaped tips of a radius of 100 μm, are implanted in the holding member 192.

FIG. 5(D) shows a separation brush in which the tip of the conductive discharging tape 194 is formed into a saw-tooth shape and sandwiched by holding members 192. As the conductive discharging tape 194, Teijin anti-static metal tape (made by Teijin Co.) and Shintron 9212 (made by Shintron Fabric Co.) are used.

FIG. 5(E) shows a separation brush in which the above described separation brushes are formed into a roller shape, and metallic needles, conductive filaments or conductive webs protrude from the peripheral surface of the cylinder.

(Example)

| | |
|---|---|
| Exposure light source: | semiconductor laser |
| Photoreceptor: | drum or belt in which an organic light conductive layer is provided on an aluminum base board. OPC photoreceptor including Y type titanyl phthalocyanine |
| Developer: | toner (yellow Y, magenta M, cyan C, black BK) the toner particle size is 7.5 μm, the charged amount is −20 μC/g, toner density is 7%, carrier the particle size is 45 μm, Cu—Zn-ferrite, St-MMA copolymer coating |
| Photoreceptor drum (10): | the diameter is 100 mm, the line speed is 74 mm/sec |
| Transfer roller (18): | the outer diameter is 24 mm, the width of the transfer roller (18); the elastic portion is made of polyurethane rubycell roller (made by Nitto Kogyo Co.), (the electric resistance measured between the shaft body 181 and the peripheral surface of the roller is $5.0 \times 10^4$ Ω at the time of impression of 100 V), the coating layer portion (183) is made of PVDF, (refer to FIG. 4(B)). |
| Separation brush (19): | stainless steel wire brush (refer to FIG. 5(B)), the protrusion of the metallic wire (191) from the holding member is 5 mm, the interval between bundles of metallic wires is 2 mm, the diameter of the metallic wire is 100 μm, the brush is composed of non-spark JS type wires (made by Achilles Co.) |
| Arrangement and operations of the transfer roller (18) and the separation brush (19): | the separation brush 19 is located close to a position right below the photoreceptor drum 10 with respect to the vertical direction and can move toward the center of the photoreceptor drum 10. |

The transfer roller 18 is located at the upstream portion of the separation brush 19 and at an interval of 15 mm on the peripheral surface of the photoreceptor drum 10, and can move in the direction of the center of the photoreceptor drum 10.

The transfer roller 18 and separation brush 19 are pressure-contacted with the photoreceptor 10 surface for nipping the recording sheet P only when the recording sheet P passes through the apparatus. That is, the transfer roller 18 starts the pressure-contact when the leading edge of the recording sheet P is fed to the position which is 5 mm upstream from the nip position. The transfer roller and the separation brush are separated from the photoreceptor 10 surface when the recording sheet P does not pass through the apparatus.

The surface potential voltage of the photoreceptor drum 10 is controlled to be −750 V at positions opposite to developing sleeves 141 of the developing units 14Y, 14M, 14C, and 14K.

Developing Bias Voltage

Developing bias voltages of developing units 14Y, 14M, 14C, 14K are set so as to be −650 VDC and 2.4 $KV_{P-P}$, 8 KHz, AC respectively.

TABLE 1

| | Color of toner | | | | | | |
|---|---|---|---|---|---|---|---|
| | Y | M | C | K | R | G | B |
| Adhesion amount of toner (mg/cm$^2$) | 0.85 | 0.85 | 0.80 | 0.90 | 1.40 | 1.42 | 1.45 |

The above table 1 shows the toner adhesion amounts of each color on the photoreceptor drum 10. The following experimental data can be obtained under the conditions shown in Table 1. In Table 1, Y shows yellow toner, M is magenta toner, C is cyan toner, and K is black toner. R (red) is Y toner superimposed on M toner. G (green) is Y toner superimposed on C toner. B (blue) is M toner superimposed on C toner.

TABLE 2

| | Transfer current $I_t$ (μA) | $V_s$ (DC) (KV) | $V_s$ (AC) (KV) | f (Hz) | Transfer success ratio % Y | M | C | K | R | G | B | Separation jam Number of jammed sheets/ number of sheets | Evaluation of image quality |
|---|---|---|---|---|---|---|---|---|---|---|---|---|---|
| Example | +20 | −0.6 | 0.3 | 20 | 90 | 90 | 90 | 85 | 83 | 83 | 83 | 2/100 | ○ |
| Example | +20 | −0.8 | 0.2 | 30 | 88 | 92 | 91 | 88 | 85 | 88 | 83 | 2/100 | ○ |
| Example | +20 | −1.0 | 0.3 | 50 | 85 | 95 | 94 | 83 | 86 | 90 | 84 | 0/100 | ○ |
| Example | +20 | −1.2 | 0.4 | 40 | 88 | 85 | 93 | 88 | 83 | 82 | 88 | 0/100 | ○ |
| Example | +20 | −1.4 | 0.2 | 100 | 92 | 90 | 91 | 90 | 84 | 85 | 82 | 2/100 | ○ |
| Example | +20 | −1.6 | 0.3 | 30 | 94 | 91 | 93 | 92 | 89 | 86 | 83 | 1/100 | ○ |
| Comparative example | $V_t$ = 1.8 KV | −1.0 | 0.4 | 50 | 85 | 85 | 85 | 80 | 70 | 70 | 65 | 10/100 | X |
| Example | +30 | −0.6 | 0.2 | 30 | 90 | 90 | 91 | 92 | 95 | 95 | 94 | 3/100 | ○ |
| Example | +30 | −0.8 | 0.3 | 50 | 89 | 91 | 88 | 89 | 95 | 96 | 95 | 2/100 | ○ |
| Example | +30 | −1.0 | 0.4 | 20 | 88 | 85 | 86 | 87 | 92 | 95 | 93 | 0/100 | ○ |
| Example | +30 | −1.2 | 0.2 | 40 | 84 | 83 | 85 | 86 | 93 | 95 | 94 | 1/100 | ○ |
| Example | +30 | −1.4 | 0.4 | 50 | 86 | 83 | 87 | 83 | 95 | 94 | 93 | 2/100 | ○ |
| Example | +30 | −1.6 | 0.4 | 20 | 83 | 88 | 88 | 89 | 94 | 90 | 91 | 0/100 | ○ |
| Comparative example | $V_t$ = 1.8 KV | −1.0 | 0.3 | 30 | 75 | 74 | 73 | 72 | 74 | 73 | 72 | 20/100 | X |

$V_S$(DC): DC separation voltage,
$V_S$(AC): AC separation voltage,
f: frequency
Separation bias voltage $V_S(t) = V_S(DC) + V_S(AC) \cdot \sin 2\pi ft$ Table 2 is a relationship between the transfer current $I_t$ and separation current $I_s$ obtained when the no-coating monolayer type transfer roller 18 shown in FIG. 4(A) is used. Mark 0 denotes superior image quality while mark X denotes interior image quality. The following results can be obtained from Table 2. In the example of the present invention in which the transfer current $I_t$ is controlled so as to be a constant current of +20 μA, the separation voltage $V_s$ is changed depending on types of recording sheets which pass through the transfer/separation portion. However, separation jams seldom occur, and a high quality transfer image without poor printing, such as blank areas can be obtained. In contrast to this result, as shown in the comparative example, when the transfer voltage $V_t$ is controlled to be constant in the conventional constant voltage control method, occurrence of separation jam is increased, the image density is reduced, and partial white streaks caused by image repelling occur.

Further, when the transfer current $I_t$ is controlled to be a constant current of +30 μA, separability and the transfer image quality are increased. That is, in any case where the transfer current $I_t$ is set to +20 μA or +30 μA, the following results can be obtained. The transfer success ratio is high with respect to each type of recording sheet, separation jams hardly occur, and a superior transfer image can be obtained by the constant current control.

TABLE 3

| | Transfer current $I_t$ (μA) | $V_s$ (DC) (KV) | $V_s$ (AC) (KV) | f (Hz) | Transfer success ratio % Y | M | C | K | R | G | B | Separation jam Number of jammed sheets/ number of sheets | Evaluation of image quality |
|---|---|---|---|---|---|---|---|---|---|---|---|---|---|
| Example | +25 | −0.4 | 0.2 | 100 | 89 | 88 | 91 | 90 | 91 | 90 | 90 | 3/100 | ○ |
| Example | +25 | −0.6 | 0.3 | 50 | 91 | 90 | 93 | 92 | 92 | 91 | 90 | 2/100 | ○ |
| Example | +25 | −0.8 | 0.3 | 150 | 92 | 91 | 92 | 90 | 88 | 89 | 90 | 0/100 | ○ |
| Example | +25 | −1.0 | 0.3 | 30 | 90 | 90 | 88 | 90 | 85 | 88 | 84 | 2/100 | ○ |
| Example | +25 | −1.2 | 0.2 | 70 | 88 | 85 | 89 | 91 | 90 | 89 | 92 | 1/100 | ○ |
| Example | +25 | −1.4 | 0.1 | 50 | 86 | 93 | 90 | 90 | 92 | 88 | 93 | 3/100 | ○ |
| Comparative example | $V_t$ = 1.8 KV | −1.0 | 0.3 | 50 | 70 | 72 | 68 | 63 | 93 | 92 | 90 | 15/100 | X |

Table 3 is data in which the separability is tested using the transfer roller 18 having coated layer portion 183 as shown in FIG. 4(B). Mark O denotes superior image quality while mark X denotes inferior image quality. That is, the transfer roller 18, the coated layer portion 183 of which is composed of 100 μm PVDF with a total layer resistance of $1\times10^6\Omega$, is used in this experiment, and the transfer current $I_t$ of +25 μA is supplied to the transfer roller 18. Although the separation voltage $V_s$ fluctuates when each recording sheet passes through the apparatus, the successful transfer ratio is high, the separation jam hardly occurs, and a high transfer image quality can be obtained when the transfer current $I_t$ is controlled to be constant.

Figure 6:
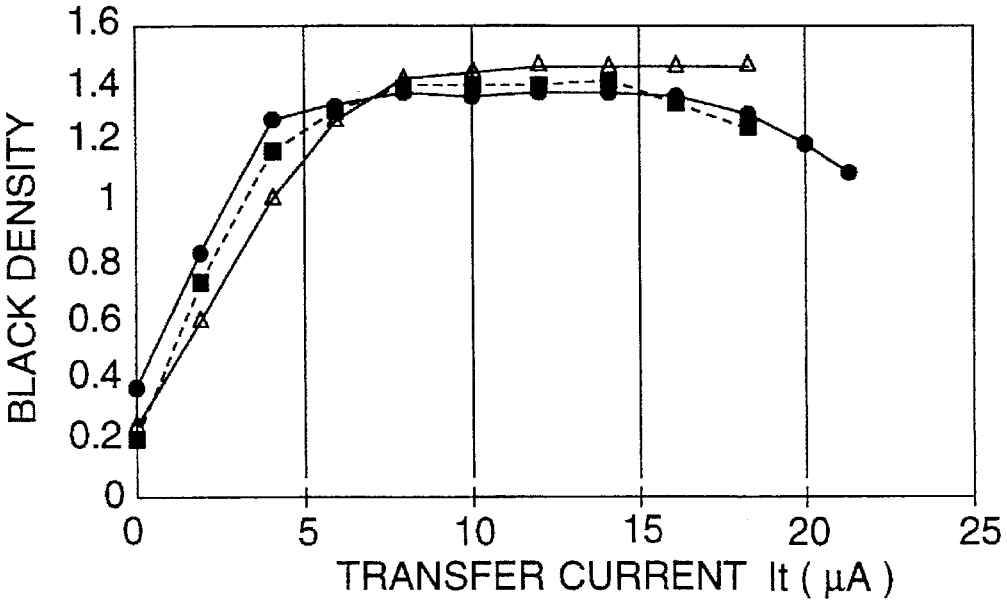
FIGS. 6(A) and 6(B) are characteristic views showing the comparison of densities by different transfer power source control methods at the time when black toner is used with respect to the sheet quality of various recording sheets.
Figure 6:
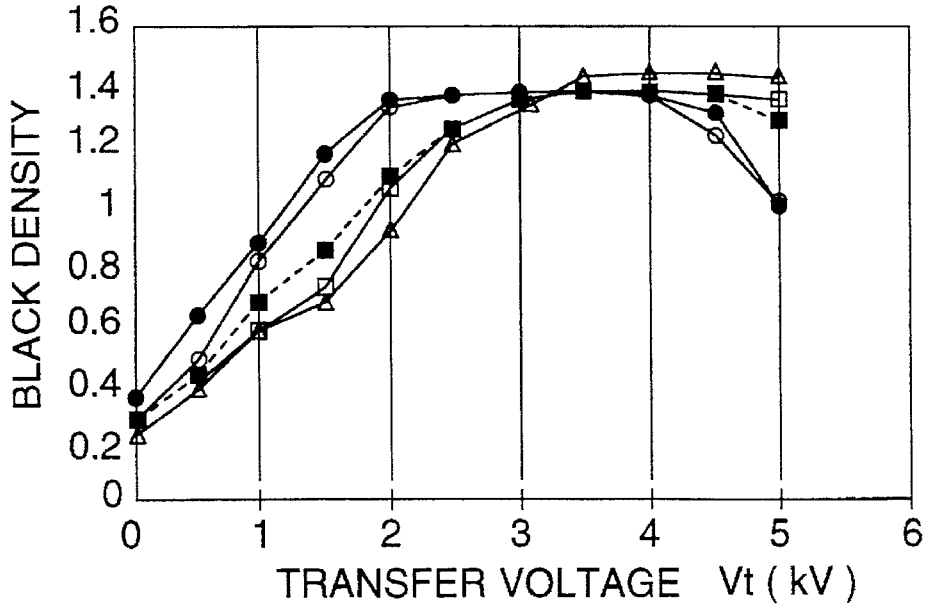

FIGS. 6(A) and 6(B) are views showing characteristics of the comparative results of differences between the constant current control mode (present invention) of the transfer current depending on the quality of each type of recording sheet and the constant voltage control mode (prior arts) in the case where black toner is used.

FIG. 6(A) is a view showing the characteristics of the results in which black toner (BK) transfer densities on recording sheets $P_1$, $P_2$, $P_3$, $P_4$, $P_5$ are measured using the constant current source according to the present invention. The following recording sheets are used in the test: 20 lbs sheet for Xerox copier ($P_1$); 241 lbs sheet for Xerox copier ($P_2$); 110 kg sheet for Konica copier ($P_3$); 55 Kg sheet for Konica copier ($P_4$); and 55 Kg recycled sheet for Konica copier ($P_5$). As shown in the drawing, when the transfer current $I_t$ is controlled to be within a range of 7 to 14 μA, characteristic curves for respective sheets approximately coincide with each other. Black toner densities of recording sheets $P_1$ through $P_5$ are approximately constant, and the density difference is small even when any type of recording sheet is used.

In contrast to the above, as shown in FIG. 6(B), large differences are generated between characteristic curves of recording sheets $P_1$ through $P_5$ and fluctuations of black toner densities for respective recording sheets are high, in the prior art in which the transfer voltage $V_t$ is controlled to be constant using the constant voltage power source.

Figure 7:
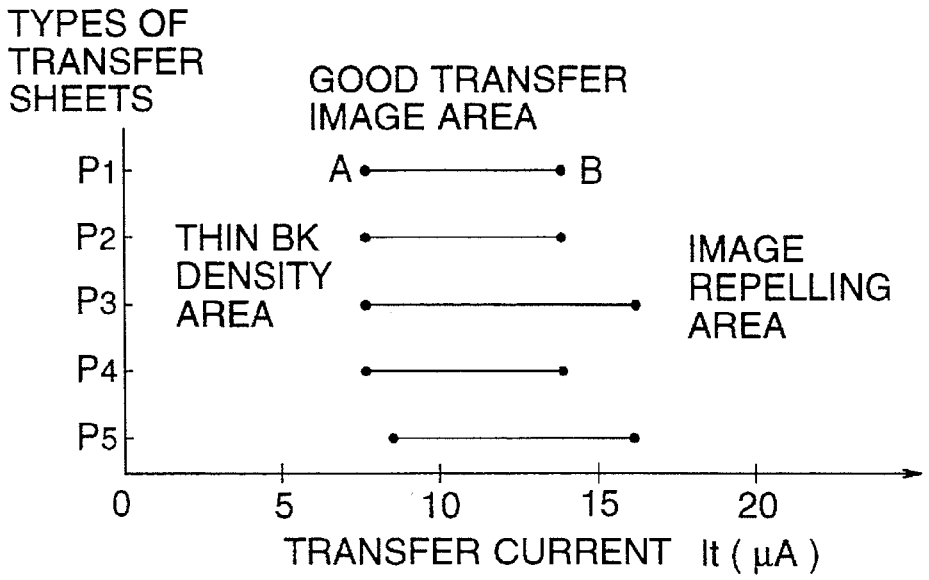
FIGS. 7(A) and 7(B) are characteristic views showing the comparison of differences of the image quality by the different transfer power source control methods with respect to the quality of various recording sheets.
Figure 7:
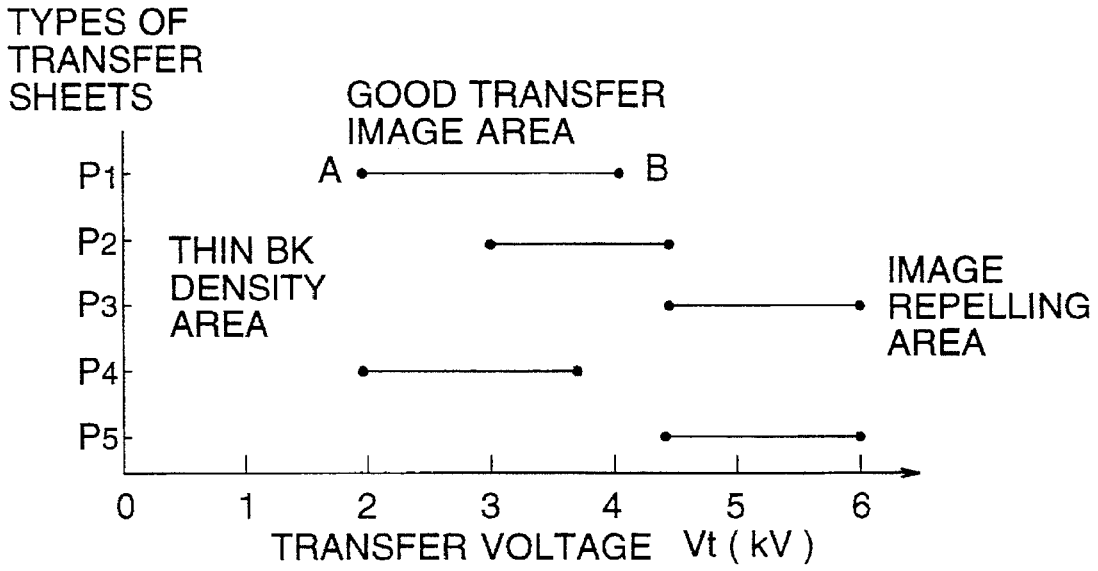

FIGS. 7(A), and 7(B) are views showing the characteristics of the comparative results of the differences between the constant current control mode (present invention) depending on the quality of the recording sheets $P_1$ to $P_5$ and the constant voltage control mode (prior art).

FIG. 7(A) is a view showing the black toner (BK) transfer characteristics of the foregoing recording sheets $P_1$ through $P_5$ when the constant current source according to the present invention is used. In FIG. 7(A), lines A–B show the area in which a good transfer image can be obtained. On the left side of point A shown in FIG. 7(A), the density of black toner (BK) is low. The right side of point B in FIG. 7(A) is a separation area and image repelling occurs, so that the density of transfer image is partially lowered. In both left and right side areas of the lines A–B, the image quality is lowered. However, when the transfer current $I_t$ is controlled to be constant within the range of 8 to 14 μA, a good image can be obtained even when any of the recording sheets $P_1$ through $P_5$ is used.

FIG. 7(B) shows the results of the comparative example in which recording sheets $P_1$ to $P_5$ are transferred and separated by the conventional constant voltage control. In this comparative example, good transfer image areas are largely dispersed depending on the type of recording sheets, and the constant voltage control by the common transfer voltage $V_t$ can not be conducted.

Figure 8:
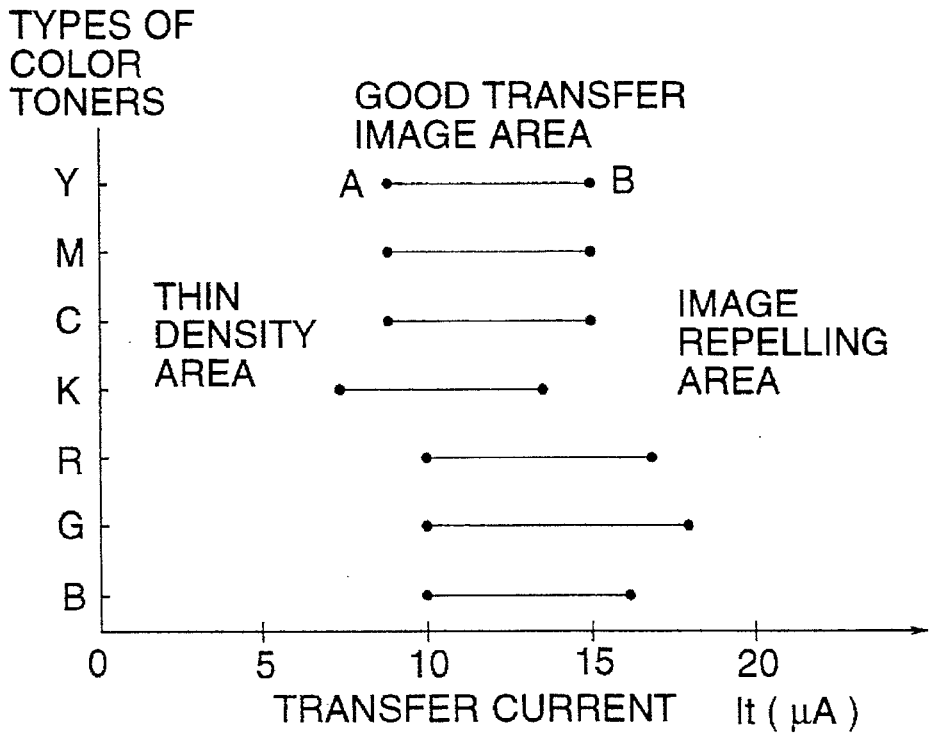
FIGS. 8(A) and 8(B) are characteristic views showing the comparison of the image quality by different transfer power source control methods in a color image forming apparatus in which color toners are used.
Figure 8:
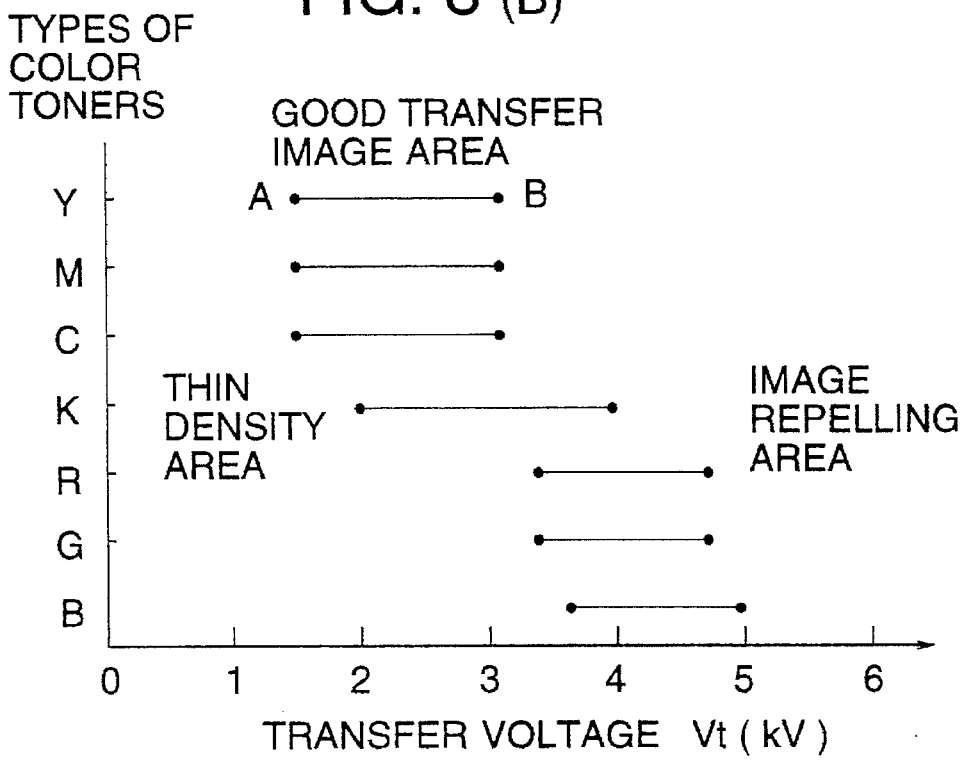

FIGS. 8(A) and 8(B) are views showing comparative results of the differences between the constant current control mode and constant voltage control mode in the color image forming apparatus in which color toners (Y, M, C, K or R, G, B) are used.

FIG. 8(A) shows the following: in the constant current control mode according to the present invention, good transfer image areas between lines A–B can be controlled when the range of transfer current $I_t$ equals 10 to 15 μA, which is common for each color toner. Accordingly, when the current for the constant current control is set within this range, a good color transfer image can be obtained.

In contrast to this, in the constant voltage control mode by the conventional technology, the transfer voltage $V_t$ area which is common for each color toner does not exit, so that a well-balanced good color transfer image can not be obtained.

As a constant current control device for use in the above-described constant current control, for example, Trek Model 610-C high voltage power source/amplifier and control device (made by Trek Co. (USA)) is used. The test results obtained by the constant current control of the transfer current according to the present invention (the voltage is limited to 6 KV) are compared with those obtained by the constant voltage control (the current is limited to 50 μA) in the comparative example, and then the foregoing comparative data were obtained.

Figure 9:
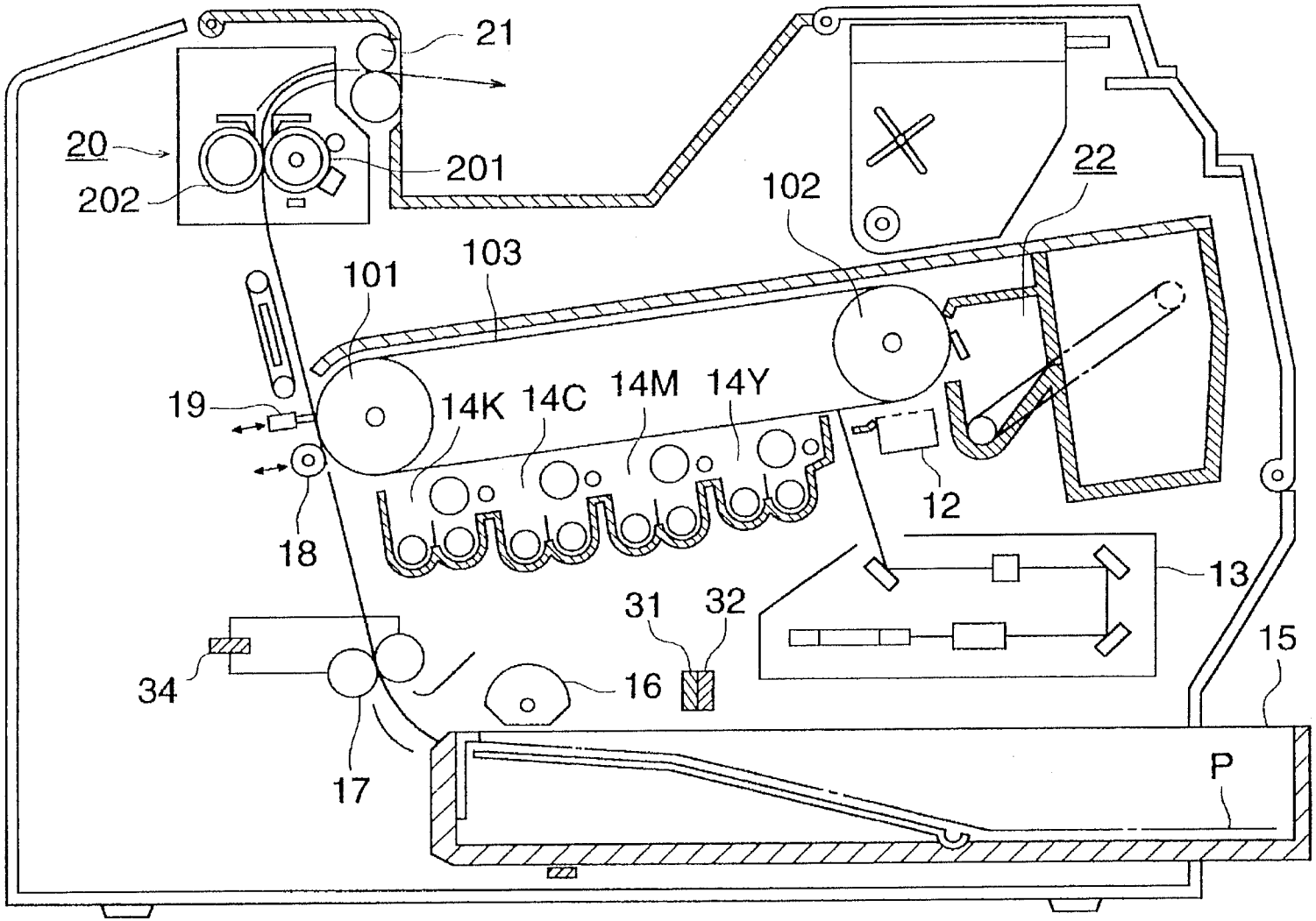
FIG. 9 is a sectional view showing other example of the color printer to which this invention is applied.

FIG. 9 is a sectional view of a color printer which is another example of the image forming apparatus to which the present invention is applied. Here, parts having the same function as those shown in FIG. 1 are denoted by the same code and symbols. Different points from the above-described example will be explained below.

The scorotron charger 12, the image exposure means (semiconductor laser light beam scanning device) 13, developing units 14Y, 14M, 14C, 14K, the transfer roller 18, the separation brush 19 and the cleaning device 22 are arranged around the photoreceptor belt (image carrier) 103 which is wound around the drive roller 101 and the driven roller 102, and which is rotatable.

With the photoreceptor belt 103 wound on the drive roller whose diameter is larger than 70 mm, problems occur in the transfer property and separability in the same manner as with the foregoing photoreceptor drum having a large diameter. Accordingly, when the transfer current $I_t$ is controlled to be constant in the same manner as the foregoing example, the successful transfer ratio can be increased, separation jams can be prevented, and the transfer image quality can be improved under the conditions which are common to each type of recording sheet and each color toner.

Further, the separability and the transfer image quality can be improved when the environmental temperature and humidity detection signals by the temperature detection means 31 and humidity detection means 32 provided in the casing of the image forming apparatus, or the detection signal by the transfer material electrical resistance detection means provided at the transfer material feeding path are inputted and the DC component of the separation voltage of the power source for separation is controlled, which will be described later.

The present invention is effective for the increase of the successful transfer ratio, the prevention of jams at the separation portion, and the improvement of the transfer image quality, under the conditions which are common to each type of recording sheet and each color toner, in the image forming apparatus in which the photoreceptor drum having a diameter larger than 70 mm, or the photoreceptor drum whose radius of curvature is larger than 35 mm at the transfer/separation position is used. Specifically, the present invention is applied to the color image forming apparatus in which color toner images are superimposed on the image carrier, so that both transfer and separation operations can be satisfactorily conducted and good color images can be obtained.

Next, the structure and the operation of the color printer, which is another example of the image forming apparatus according to the present invention, specifically in order to keep separation stability even in variations of the environmental temperature, humidity and for various types of transfer sheets, is explained below according to FIG. 1, and further differences from the apparatus shown in FIG. 1 will be described below.

FIG. 5(F) is a front view of the apparatus shown in FIG. 5(B). In FIG. 5(F), the fine conductive wires 191 are implanted in the holding member 192 in the following manner: fine wires of 0.1 mm diameter are bundled; the protruded length L of the wire (the length of the bristle) is 2 to 20 mm; the pitch P between bundles is 0.5 to 5 mm. As the fine conductive wire 191, fine metallic wire (metallic fiber) or conductive fibers may be used.

The fine metallic wire has normal conductivity and rigidity, and can be selected from the following metal: stainless steel, iron, copper, aluminum, tungsten, chromium, nickel, nickel chromium steel, silver, lead, tin, zinc, and alloy or amorphous metal including these metals.

As conductive fibers, rayon or nylon including inorganic conductive material such as carbon or organic conductive material, or resin (plastic) such as polyester resin can be used.

The electrical conductivity of the fine conductive wire 191 is preferably lower than $10^5$ Ω·cm, and its lower limit value is determined depending on the rigidity of the material itself.

In the foregoing fine conductive wires 191, for example, Achilles non-spark JS type fine wire (0.1 mm diameter) (made by Achilles Co.), or the amorphous fiber NAmV10-5-12-285 (0.1 mm diameter) (made by Toei Sangyo Co.) can be used in this example.

When the protruded length L of the fine conductive wire 191 of the separation brush 19 is too short, discharge hardly occurs between the image carrier 110 and the separation brush 19 through the transfer material P. Therefore, high voltage should be impressed upon the separation brush. Accordingly, transfer repelling occurs, which leads to the separation failure of the transfer material. When the protruded length L is too long, the image unevenness is generated in the direction perpendicular to the transfer material conveyance direction (the longitudinal direction of the separation brush 19), or the durability of the separation brush itself deteriorates.

When the pitch p between bundles of fine wires of the separation brush 19 is too large, image unevenness occurs. When the pitch p is too small, over-current easily flows at the time of separation, and separation repelling or further separation failure is generated.

(Example)

Conditions which are different from the foregoing example are described as follows.

Separation brush (19): (refer to FIGS. 5(B), 5(F)) the protrusion of the fine conductive wires (191) from the holding member is 3 to 10 mm, intervals of bundles of metallic wires are 0.6 to 4.0 mm, the diameter of the metallic wire is 100 μm, the brush is composed of non-spark JS type wires (made by Achilles Co.) and amorphous fiber NAmV10-5-12-285 (made by Toei Sangyo Co.)

Figure 10:
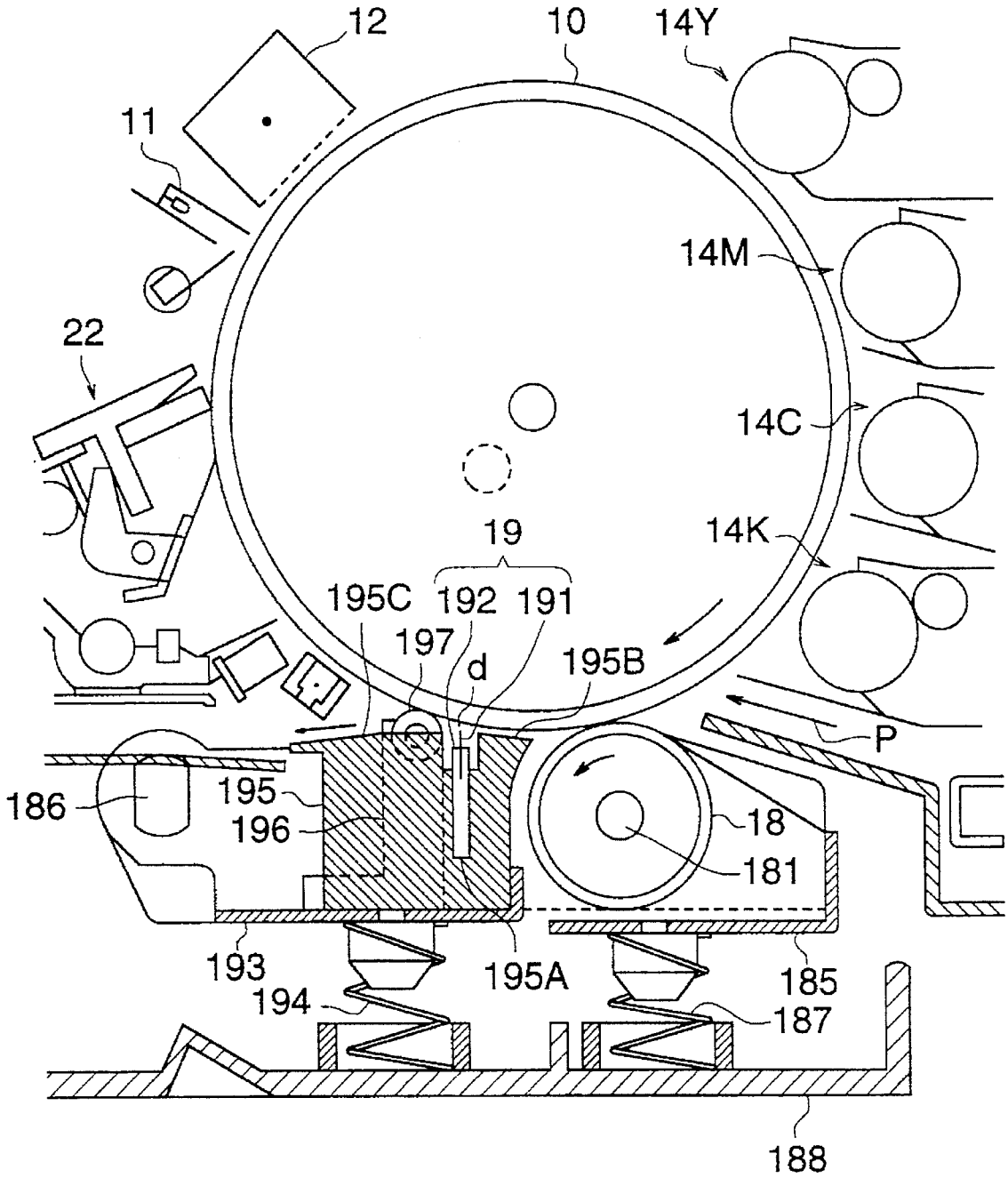
FIG. 10 is a central sectional view showing a primary portion of the image forming apparatus at the time of transfer according to the present invention.

Next, FIG. 10 is a sectional view of the center of the main portion of the image forming apparatus according to the present invention, and shows the state of transfer.

The transfer means and separation means are formed into a transfer/separation unit, and this unit can be in contact with and separated from the peripheral surface of the image carrier 10.

Both shaft ends of the shaft body 181 of the transfer roller 18 are held by two side plates of the first movable holding member 185 so that both shaft ends can be freely oscillated. The first movable holding member 185 is supported around the support shaft 186 so that the holding member 185 can be oscillated. The movable holding member 185 is pushed upward toward the image carrier 10 side by the coil spring 187. Numeral 188 shows a stationary base board fixed to the image forming apparatus main body.

The second movable holding member 193 is coaxially supported by the support shaft 186 so that the holding member 193 can be oscillated. The second movable holding member 193 moves being linked with the first movable holding member 185 and is integrally oscillated with the first movable holding member 185 by a linking member not shown in the drawings. The bottom surface of the second movable holding member 193 is pushed upward by the coil spring 194 in the same way as the transfer roller 18.

A transfer material conveyance guide member 195 is fixed on the second movable holding member 193 in the downstream side of the transfer material conveyance direction of the separation brush 19 at the intermediate portion between the transfer roller 18 and the separation brush 19. The holding member 192 of the separation brush 19 is inserted into a slit portion 195A of the transfer material conveyance guide member 195. The tip portion of the fine conductive wire 191 of the separation brush 19 is fixed while keeping a predetermined distance from the peripheral surface of the image carrier 10.

An upper surface portion 195B of the transfer material conveyance guide member 195, which is located in the intermediate portion between the transfer roller 18 and the separation brush 19 has a long guide surface in the direction perpendicular to the drawing shown in FIG. 10, covers the maximum width of the transfer material P, and maintains a predetermined narrow gap from the surface of the image carrier 10. The transfer material P conveyed from the nip portion of the transfer roller 18 passes through a gap between the upper surface portion 195B of transfer material conveyance guide member 195 and the surface of the image carrier 10, and passes over the tip portion of the separation brush 19. In this case, since the gap is set so that the leading edge of the transfer material P is not directly contacted with the side surface of the fine conductive wire 191 of the separation brush 19, the separability can not be lowered by the fall-down or brush-fiber bending of the fine conductive wires 191, and the fine conductive wires 191 can not be damaged.

The conveyance guide surface 195C for guiding the transfer material P to the fixing device 20 side is formed on the upper surface of the transfer material conveyance guide member 195; this upper surface is located at the downstream side of the separation brush 19. A plurality of ribs are formed, in the transfer material conveyance direction, on the upper surface portion 195B and conveyance guide surface 195C of the transfer material conveyance guide member 195 so that the transfer material P is more smoothly conveyed.

The transfer material conveyance guide member 195 is an insulating material such as resin molding parts made of, for example, polyethylene terephthalate (PET), ABS resin, etc. Since high voltages are impressed upon the transfer roller 18 and the separation brush 19, the polarity of which is reverse to each other, discharge easily occurs in the space between the two members. Accordingly, uneven transfer and separation failure are caused, and the transfer roller 18 or the separation brush 19 is damaged. This problem can be easily solved when the insulating transfer material conveyance guide member 195 is mounted between the transfer roller 18 and the separation brush 19.

Separation member position regulation means are provided on both surfaces of the second movable holding member 193. Roller holding members 196 of the separation member position regulation means are fixed to the second movable holding member 193. A roller 197 with a rotation shaft is rotatably supported by the upper portion of the roller holding member 196. The height of the upper end of the peripheral surface of the roller 197 and that of the tip portion of the separation brush 19 are respectively set at predetermined distances in the vertical direction so that the tip portion of the separation brush 19 has a predetermined gap d from the peripheral surface of the image carrier 10 when the roller 197 is contacted with the peripheral surface of the image carrier 10. When the predetermined gap is maintained, discharge is stably conducted between the tip portion of the separation brush 19 upon which high voltage is impressed, and the peripheral surface of the image carrier 10, so that separability is increased. Here, the separation member position regulation means is mounted outside the image formation area on the peripheral surface of the image carrier 10.

As described above, the transfer/separation unit is supported around the support shaft 186 so that the unit can be oscillated. The transfer/separation unit is pushed upward by coil springs 187 and 194 at the time of transfer. The transfer roller 18 is pressure-contacted with the peripheral surface of the image carrier 10, and the transfer roller 18 is driven thereby.

Figure 11:
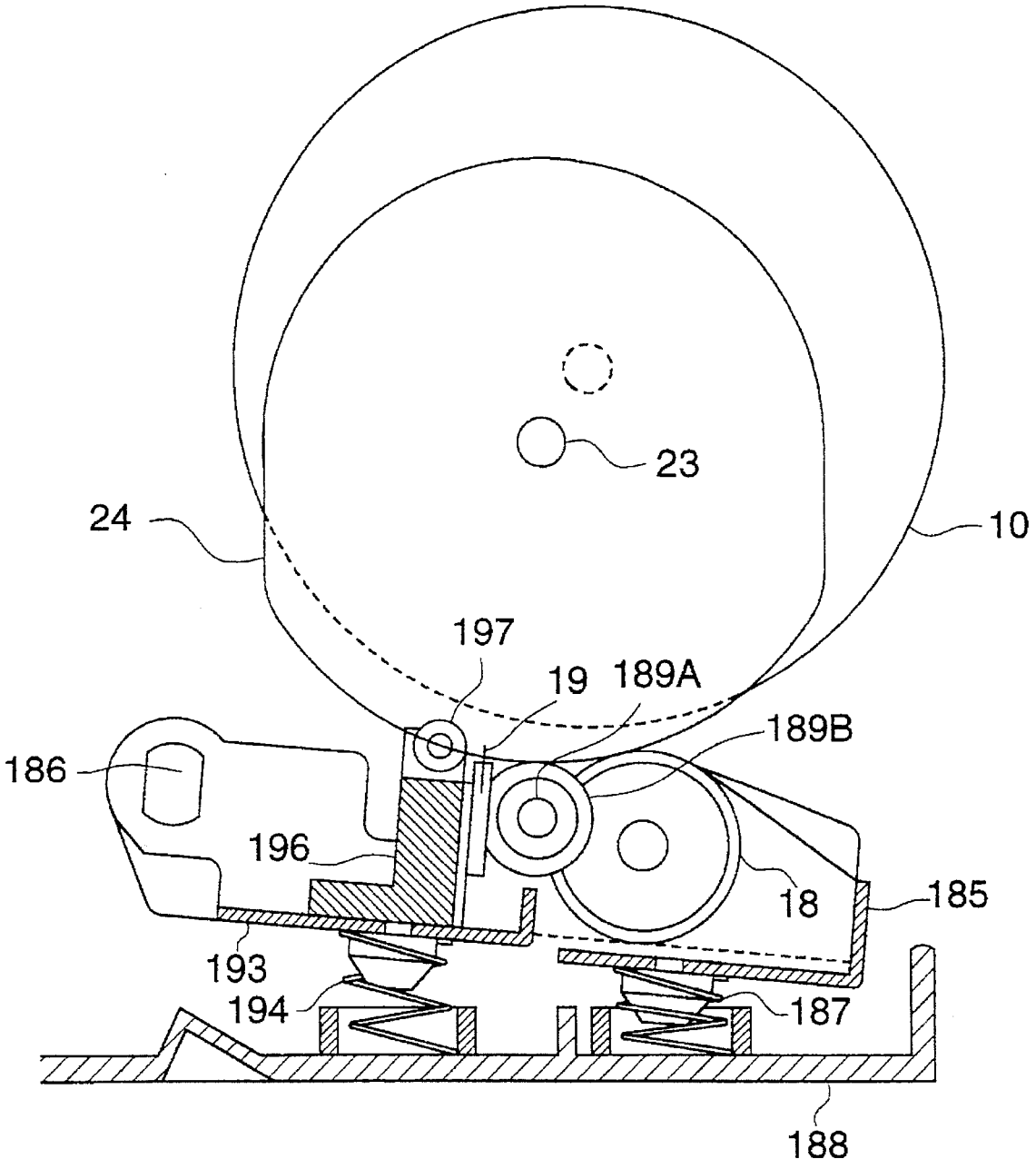
FIG. 11 is a sectional view showing a condition in which the transfer and separation apparatus are separated from an image carrier.

In conditions except image transfer, that is, in the process in which different color toner images (Y, M, C, K) are formed on the image carrier 10, the transfer/separation unit is forced to be separated from the peripheral surface of the image carrier 10. FIG. 11 shows the condition of this separation.

A stationary shaft 189A is horizontally implanted in both sides of the first movable holding member 185, and a roller (cam follower) 189B is rotatably engaged with the stationary shaft 189A.

On the other hand, a rotatable cam shaft 23 which is connected to the driving source of the image forming apparatus is supported above the transfer/separation unit, and a cam 24 is fixed to the cam shaft 23. The peripheral surface of the cam 24 is pressure-contacted with the roller 189B of the transfer/separation unit. When the peripheral surface with the maximum radius is pressure-contacted with the roller 189B by the rotation of the cam, the transfer/separation unit is oscillated downward around the support shaft 186, and the transfer roller 18 and the separation brush 19 are separated from the peripheral surface of the image carrier 10.

In the condition in which the peripheral surface with the maximum radius is pressure-contacted with the roller 189B by the rotation of the cam 24, the transfer/separation unit is pushed upward by two springs. The transfer roller 18 is pressure-contacted with the peripheral surface of the image carrier 10 with a predetermined pressure, forms a nip, and is driven. The toner image is transferred when the transfer material passes through the apparatus. In this example, the pressing force is 300 g/cm.

The following operations are conducted at an elevation stop position: the roller 197 is pressure-contacted with the peripheral surface of the image carrier 10; a predetermined gap is maintained between the separation brush 19 and the peripheral surface of the image carrier 10; and the separation brush 19 can be separated from the peripheral surface of the image carrier 10 when the transfer material P passes through the apparatus.

In FIG. 1, the temperature detection means 31 and the humidity detection means 32 are provided inside the image forming apparatus casing 1, for example, below the separation means 19 or above the sheet feed cassette 15. The above-described temperature detection means 31 is a generally known thermocouple, for example, a copper-constantan thermocouple is most preferable. However, the temperature detection means 31 is not limited to this type of thermocouple. An alumel-chromel thermocouple or a platinum-platinum rhodium thermocouple, or bismuth-silver thermocouple, etc., may also be used as the temperature detection means 31.

The above-described humidity detection means 32 is a generally known humidity sensor such as, for example, CHS-YS, CHS-YR, CHS-GS, CHS-GR, CHS-ASG, CHS-AGR, CHS-APS, CHS-APR, etc., which are CHS-series products by TDK Co.

Figure 12:
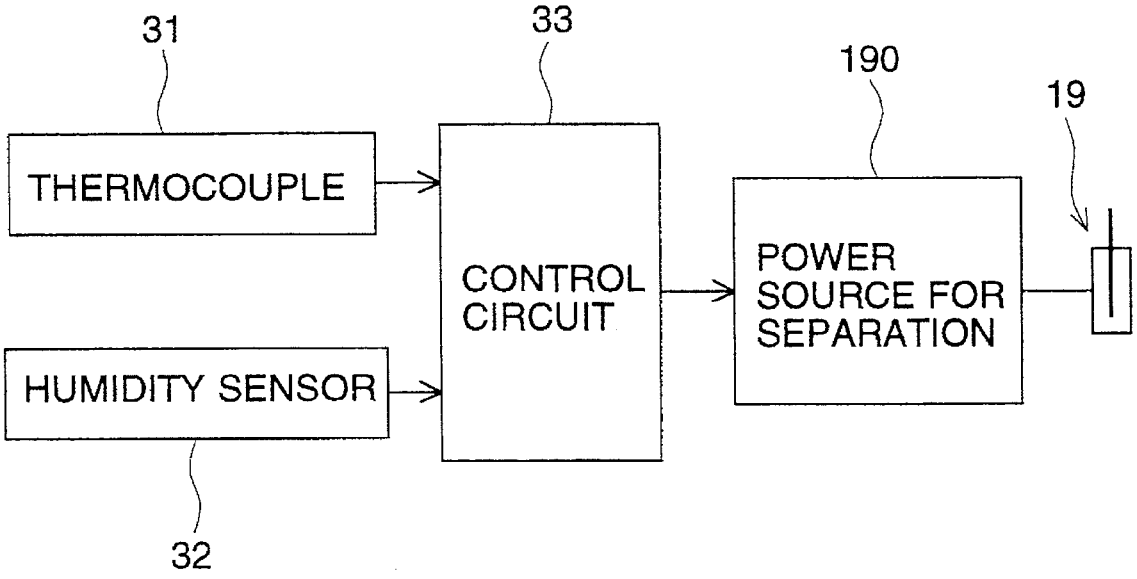
FIG. 12 is a block diagram showing the control of the power source for separation.

FIG. 12 is a block diagram showing the control of the power source for separation 190 by the temperature detection means 31 and the humidity detection means 32.

When the environmental temperature and humidity are detected by the temperature detection means 31 and the humidity detection means 32, detected signals are sent to the control circuit 33 and processed so that the separation bias voltage of the power supply for separation 190 is controlled.

Figure 13:
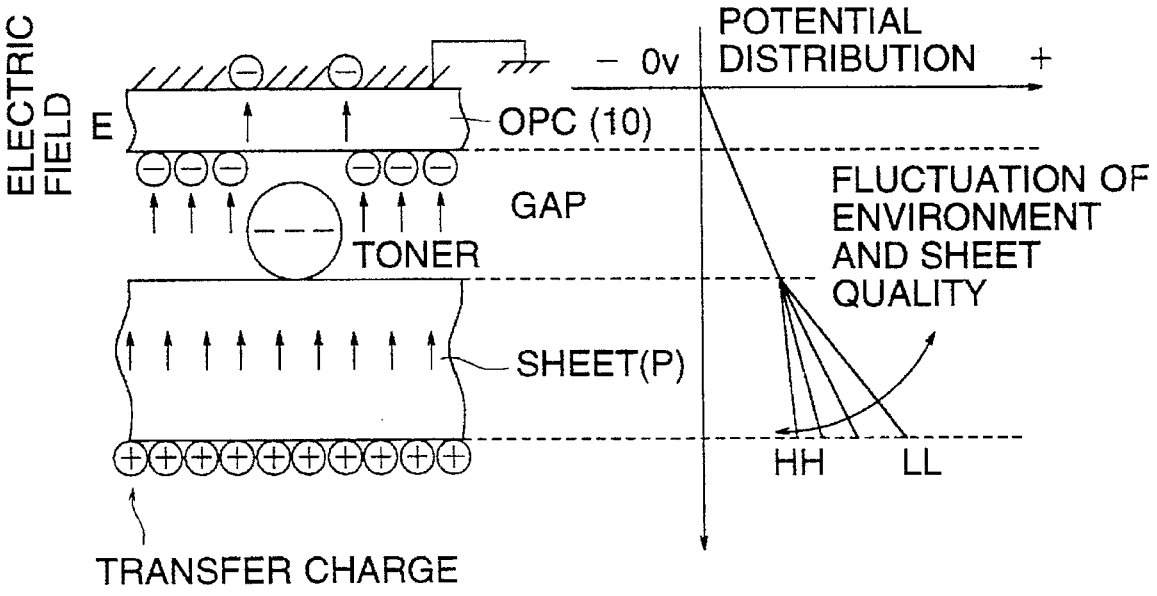
FIGS. 13(A) and 13(B) are views explaining the potential distribution of the transfer material due to environmental temperature and humidity variations and transfer sheet quality variations at the time of transfer and separation.
Figure 13:
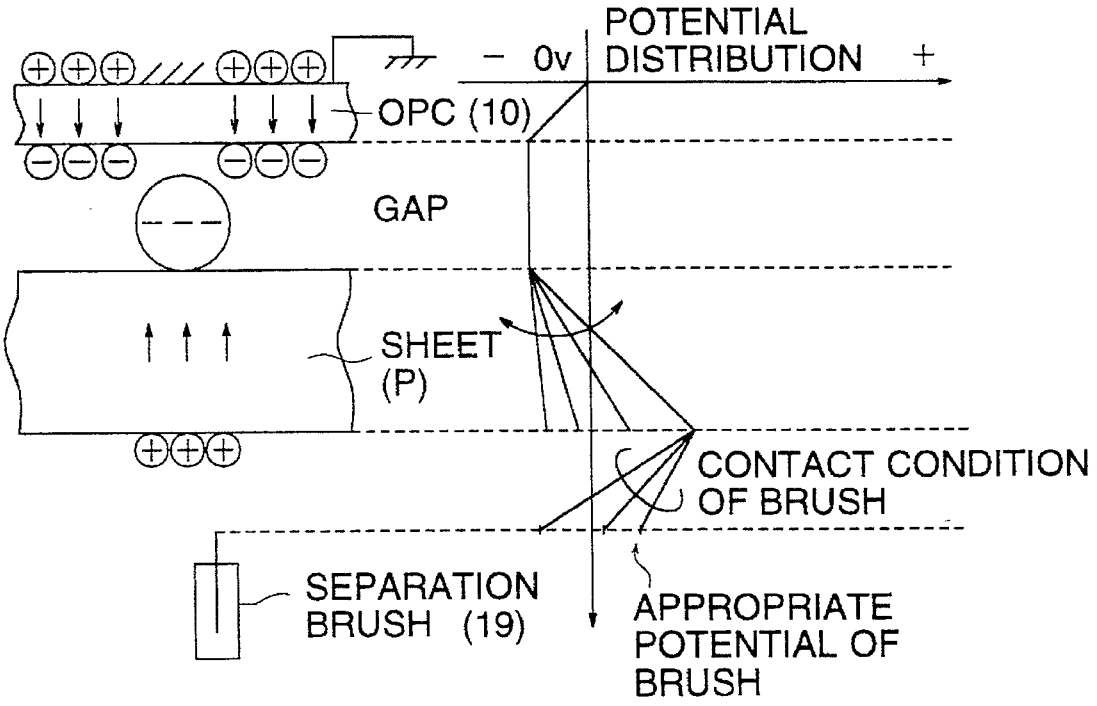

FIGS. 13(A) and 13(B) are views explaining the potential distribution of the transfer material due to fluctuations of the environmental temperature and humidity and fluctuations of the quality of the transfer material at the time of transfer and separation. FIG. 13(A) is a view showing a model of transfer and potential distribution at the time of transfer. FIG. 13(B) is a view showing a model of separation and the potential distribution at the time of separation.

When the environmental temperature and humidity in the casing 1 fluctuate widely from high temperature and high humidity (HH) condition to low temperature and low humidity (LL) condition, the sheet quality (temperature and humidity) of the transfer material P loaded in the casing 1 fluctuates, and thereby, the dielectric constant and electric resistance of the transfer material P also fluctuate, so that problems such as separation failure or deterioration of the image quality are caused. Conventionally, separation in the overall environment is conducted near zero volt by an AC corona discharge. Specifically, in the developing units 14 (14Y, 14M, 14C, 14K) by which non-contact two-component development is conducted, the attractive force between the carrier and toner in the developer is weak. Accordingly, when the dielectric constant and electric resistance of the transfer material P are slightly changed depending on the fluctuation of the environmental temperature, toner is easily scattered at the separation portion. When excessive separation voltage is impressed upon the separation means 19, toner is scattered and the image on the transfer material P is fluctuated.

Figure 14:
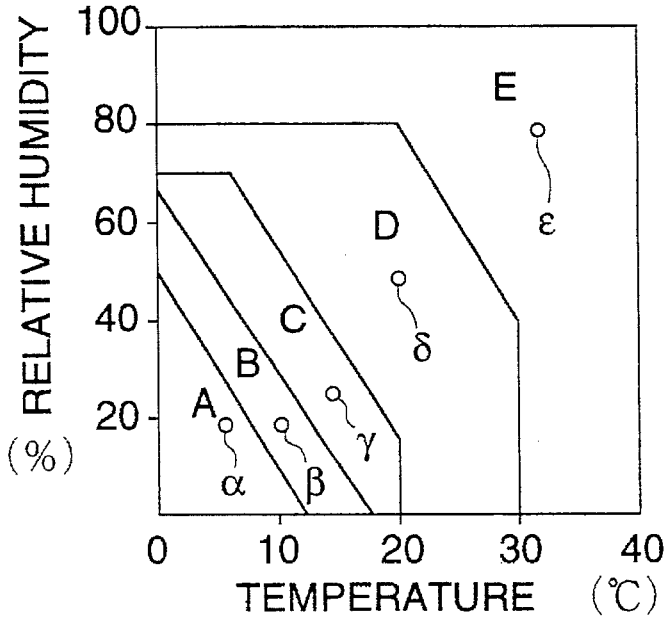
FIG. 14 is a view explaining area section settings of the environmental temperature.

FIG. 14 is a view for explaining the range setting of the environmental temperature and humidity.

In the present invention, when the environmental temperature and humidity signal detected by the temperature detection means 31 and the humidity detection means 32 which are installed inside the casing 1 is inputted into the control circuit 33, the DC component of the separation voltage of the separation means 19 is controlled from a positive polarity range to a negative polarity range.

Further, in the present invention, when the environmental temperature and humidity detection signal detected by the temperature detection means 31 and the humidity detection means 32 is inputted into the control circuit 33, the DC component of the transfer voltage of the transfer roller 18 can be variably controlled.

As shown in FIG. 14, the environmental temperature and humidity are divided into 5 zones (A, B, C, D, E) from a low temperature and low humidity (LL) range to a high temperature and high humidity (HH) range, and the separation voltages $V_{DC}$, $V_{AC}$ are controlled for each zone. Zone A is set in the low temperature and low humidity range (LL) in which the temperature is lower than 12° C. and the relative humidity (RH) is lower than 45%. Zones B, C and D are set in the normal temperature and normal humidity range (NN) shown in the drawing. Zone E is set in the high temperature and high humidity range (HH) in which the temperature is higher than 30° C. and the relative humidity (RH) is higher than 80%. The separation voltage is controlled for each zone.

TABLE 4

| | Color of toner | | | | | | |
|---|---|---|---|---|---|---|---|
| | Y | M | C | K | R | G | B |
| Adhesion amount of toner (mg/cm$^2$) | 0.80 | 0.80 | 0.85 | 0.95 | 1.44 | 1.43 | 1.45 |

Table 4 shows the toner adhesion amount for each color on the photoreceptor drum 10. The experimental data shown below was obtained under these conditions. Here, in the table, Y is yellow toner, M is magenta toner, C is cyan toner and K is black toner. Further, R (red) is a superimposed color of the Y and M toners. G (green) is a superimposed color of the Y and C toners. B (blue) is a superimposed color of the M and C toners.

kV in negative polarity by changing only DC voltage $V_{DC}$, and 100 sheets were conveyed under each of the environmental conditions represented by set points of α, β, γ, δ and ε, resulting in no occurrence of jam of transfer material P.

In Example 2, bias voltage wherein AC voltage $V_{AC}$ was superimposed on DC voltage $V_{DC}$ was used and the DC voltage $V_{DC}$ was regulated and changed for each zone within a range from +1.5 kV in positive polarity to −1.7 kV in negative polarity. Further, the AC voltage $V_{AC}$ was switched between two steps of 0.5 kv and 0.3 kV and 100 sheets were conveyed under each of the environmental conditions represented by set points of α, β, γ, δ and ε, resulting in no occurrence of jam of transfer material P.

In Example 3 too, bias voltage was switched for each zone within a range from the positive polarity to the negative polarity, and no jam was caused.

In Comparative example 1 wherein DC voltage was fixed, transfer material P failed to be separated at the set values of α, β and γ.

In Comparative example 2 wherein DC voltage and AC voltage $V_{AC}$ were fixed, transfer material P failed to be separated at the set values of γ, δ and ε.

Figure 15:
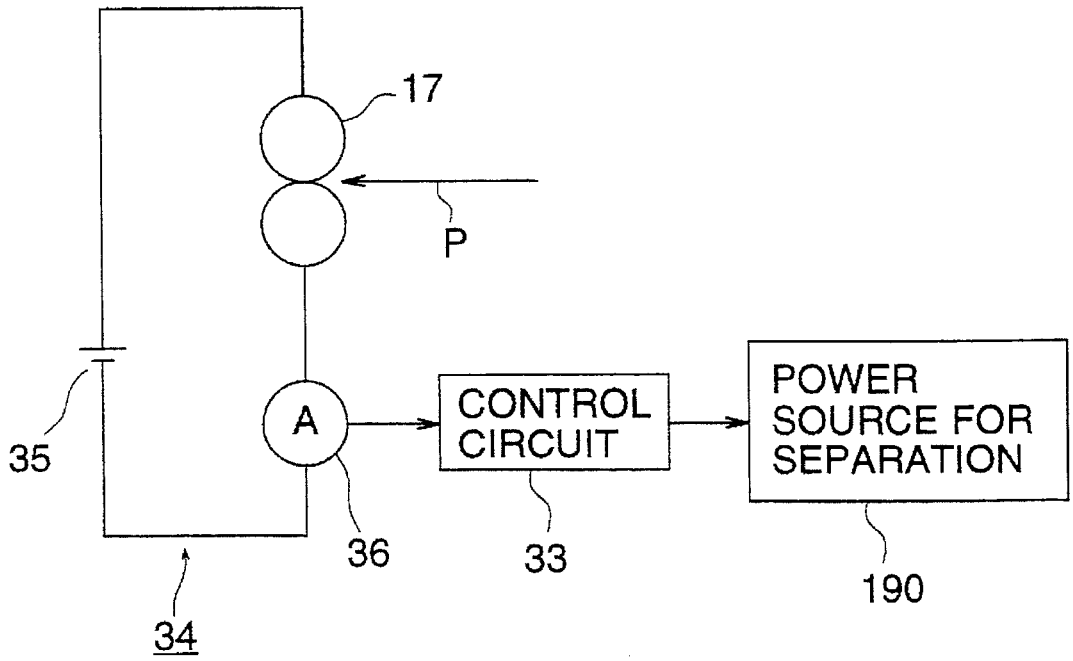
FIG. 15 is a block diagram showing a detection means of the electric resistance of the transfer sheet.

Next, a third embodiment of the invention will be explained as follows. FIG. 15 is a block diagram of electric

TABLE 5

| | Separation bias | Environment | | | | | Evaluation |
|---|---|---|---|---|---|---|---|
| | | Zone A | Zone B | Zone C | Zone D | Zone E | |
| Example 1 | $V_{DC}$ (KV) | +2.5 | +1.0 | 0 | −1.0 | −2.0 | No jam while |
| | $V_{AC}$ (KV) | 0 | 0 | 0 | 0 | 0 | 100 sheets are |
| | F (Hz) | — | — | — | — | — | fed in each of α, β, γ, δ, ε environments. |
| Example 2 | $V_{DC}$ (KV) | +1.5 | 0.5 | −0.2 | −0.7 | −1.7 | No jam while |
| | $V_{AC}$ (KV) | 0.5 | 0.5 | 0.3 | 0.3 | 0.3 | 100 sheets are |
| | f (Hz) | 100 | 100 | 100 | 100 | 100 | fed in each of α, β, γ, δ, ε environments. |
| Example 3 | $V_{DC}$ (KV) | +0.5 | +0.2 | 0 | −0.3 | −0.5 | No jam while |
| | $V_{AC}$ (KV) | 1.0 | 1.0 | 1.0 | 1.2 | 1.2 | 100 sheets are |
| | f (Hz) | 500 | 500 | 500 | 500 | 500 | fed in each of α, β, γ, δ, ε environments. |
| Comparative example 1 | $V_{DC}$ (KV) | | | −1.0 | | | Sheet can not be separated in α, β, γ. |
| Comparative example 2 | $V_{DC}$ (KV) | | | +0.5 | | | Sheet can not |
| | $V_{AC}$ (KV) | | | 0.5 | | | be separated |
| | f (Hz) | | | 100 | | | in γ, δ, ε. |

Table 5 shows Examples wherein separation voltage $V_{DC}$ and $V_{AC}$ were regulated for each of the zones of A, B, C, D and E mentioned above and the results of the tests of conventional separation voltage which were not regulated, to indicate the evaluation of separability of transfer material P. Incidentally, the following set points α, β, γ, δ and ε were used as environmental temperature and humidity applied to the tests (See FIG. 14).

α: 5° C., 20% RH, (Zone A)
β: 10° C., 20% RH, (Zone B)
γ: 15° C., 30% RH, (Zone C)
δ: 20° C., 50% RH, (Zone D)
ε: 30° C., 80% RH, (Zone E)

Incidentally, Konica recycled paper 55 kg (weight 65 g/m$^2$) was used for the test as transfer material P to be conveyed under the environmental conditions mentioned above.

In Example 1, voltage was regulated and changed within a range of five steps from +2.5 kV in positive polarity to −2.0 resistance detecting means 34 to be used in the example for transfer material P.

The aforementioned electric resistance detecting means 34 is composed of a sheet feed roller located in a conveyance path for the transfer material P, for example, a pair of conductive register rollers 17, DC power source 35 for 250 V, and ammeter 36 that detects current values of transfer material P passing through the position of a nip formed by the aforesaid register rollers 17, and it converts the output current of the ammeter 36 into electric resistance values and impresses voltage on separating means 19.

TABLE 6

| Transfer material (P) | Electric resistance Ω | | | | |
|---|---|---|---|---|---|
| | α 5° C., 20% RH | β 10° C., 20% RH | γ 15° C., 30% RH | δ 20° C., 50% RH | ϵ 30° C., 80% RH |
| Konica recycled paper 55 kg | $9.5 \times 10^8$ | $7.0 \times 10^7$ | $1.0 \times 10^7$ | $5.0 \times 10^6$ | $1.0 \times 10^4$ |
| Konica plain paper 45 kg | $2.0 \times 10^8$ | $2.0 \times 10^7$ | $2.0 \times 10^6$ | $1.0 \times 10^6$ | $5.0 \times 10^4$ |
| Konica plain paper 55 kg | $2.5 \times 10^8$ | $3.0 \times 10^7$ | $3.0 \times 10^6$ | $1.5 \times 10^6$ | $6.0 \times 10^4$ |
| Konica plain paper 70 kg | $3.0 \times 10^8$ | $4.0 \times 10^7$ | $7.0 \times 10^6$ | $3.0 \times 10^6$ | $1.0 \times 10^5$ |
| Konica plain paper 110 kg | $4.0 \times 10^8$ | $6.0 \times 10^7$ | $6.0 \times 10^6$ | $3.0 \times 10^6$ | $1.0 \times 10^5$ |
| Jamestown 16 lb paper | $1.0 \times 10^8$ | $2.0 \times 10^7$ | $1.0 \times 10^6$ | $5.0 \times 10^5$ | $2.0 \times 10^5$ |
| Hammermill 24 lb paper | $1.0 \times 10^8$ | $1.0 \times 10^7$ | $1.0 \times 10^6$ | $5.0 \times 10^5$ | $2.0 \times 10^5$ |
| Xerox 20 lb paper | $7.0 \times 10^7$ | $3.5 \times 10^7$ | $2.0 \times 10^6$ | $2.5 \times 10^5$ | $1.0 \times 10^4$ |

Table 6 shows the results of measurement of electric resistance value Ω of each transfer material P in each of the conditions of environmental temperature and humidity α, β, γ, δ and ϵ mentioned above. As a measuring instrument for the surface resistance of the aforementioned transfer material P, a high/low resistance meter made by Mitsubishi Oil Chemical Co., Hiresta IP Type MCP-HT260 was used. Incidentally, the electric resistance value of the transfer material P mentioned above is represented by the measured surface resistance of the transfer material P which was nipped between a pair of sheet feed rollers each having a width of 20 mm and forming a 2-mm-wide nip.

Figure 16:
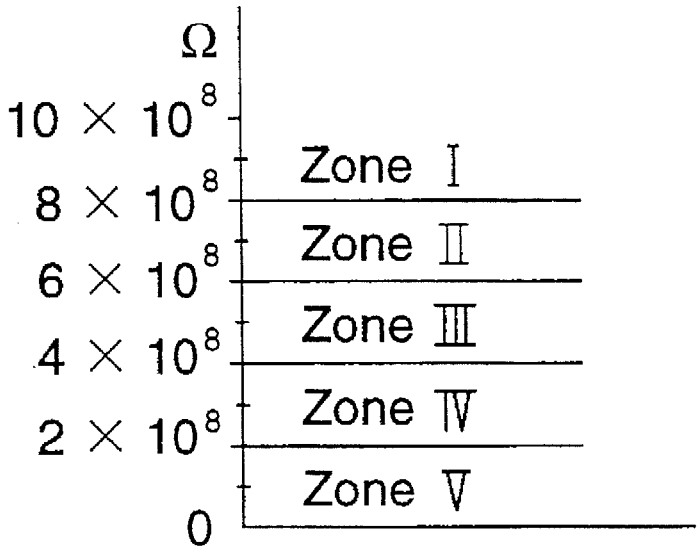
FIG. 16 is a view showing setting of sections of surface electric resistance values of various transfer sheets.

The values of surface electric resistance of each transfer material P mentioned above are classified into 5-step zones (Zones I, II, III, IV and V) shown in FIG. 16.

In the case of Comparative examples 1 and 2 representing the conventional system wherein separation voltage is fixed, separation failure sometimes occurs in both cases.

Incidentally, in the Examples mentioned above, zone setting was made to create 5 zones A–E and 5 zones I–V. However, the invention is not limited to this, but it is possible to control by setting appropriate plural zones.

In the aforesaid tests, Achilles Non-spark JS Type 100 (made by Achilles Co.) was used as separation brush 19. The separation brush 19 has a form shown in FIGS. 5(B) and 5(F), and conductive fine bristle 191 of the brush has a diameter of 100 μm, the length L of the bristle is 5 mm and a pitch P thereof is 3 mm.

Next, an entrance guide for a transfer sheet which is further effective for preventing an occurrence of image repelling in the course of transferring and for stabilizing image density will be explained as follows.

TABLE 7

| | Separation bias | Environment | | | | | Evaluation |
|---|---|---|---|---|---|---|---|
| | | Zone I | Zone II | Zone III | Zone IV | Zone V | |
| Example 1 | $V_{DC}$ (KV) | +2.5 | +1.0 | 0 | −1.0 | −2.0 | No jam while 100 sheets are fed in each of α, β, γ, δ, ϵ environments. |
| | $V_{AC}$ (KV) | 0 | 0 | 0 | 0 | 0 | |
| | F (Hz) | — | — | — | — | — | |
| Example 2 | $V_{DC}$ (KV) | +1.5 | 0.5 | −0.2 | −0.7 | −1.7 | No jam while 100 sheets are fed in each of α, β, γ, δ, ϵ environments. |
| | $V_{AC}$ (KV) | 0.5 | 0.5 | 0.3 | 0.3 | 0.3 | |
| | f (Hz) | 100 | 100 | 100 | 100 | 100 | |
| Example 3 | $V_{DC}$ (KV) | +0.5 | +0.2 | 0 | −0.3 | −0.5 | No jam while 100 sheets are fed in each of α, β, γ, δ, ϵ environments. |
| | $V_{AC}$ (KV) | 1.0 | 1.0 | 1.0 | 1.2 | 1.2 | |
| | f (Hz) | 500 | 500 | 500 | 500 | 500 | |
| Comparative example 1 | $V_{DC}$ (KV) | | | −1.0 | | | Sheet can not be separated in α, β, γ. |
| Comparative example 2 | $V_{DC}$ (KV) | | | +0.5 | | | Sheet can not be separated in γ, δ, ϵ. |
| | $V_{AC}$ (KV) | | | 0.5 | | | |
| | f (Hz) | | | 100 | | | |

Table 7 shows Examples wherein separation voltage $V_{DC}$ and $V_{AC}$ were regulated for each of the electric resistance value zones, I, II, III, IV and V mentioned above and the results of the tests of conventional separation voltage which were not regulated, to indicate the evaluation of separability of transfer material P.

In Examples 1, 2 and 3 wherein DC bias voltage $V_{DC}$ was switched and regulated within a range from the positive polarity voltage to the negative polarity voltage for each of the above-mentioned zones I–V regardless of existence of AC voltage $V_{AC}$, no jam was caused at all for all cases in the tests to convey 100 sheets of transfer material P.

When a transfer sheet is not in close contact with a photoreceptor drum at the position preceding a nip portion formed between the photoreceptor drum and a transfer roller, electric discharge takes place between the transfer sheet and the photoreceptor drum, causing image repelling. This is a cause of image repelling. When an apparatus needs to be small in size, in particular, a cassette for transfer sheets needs to be located at the lower part of the apparatus, and therefore, it is necessary to provide an entrance guide at the position preceding the transfer area for conveying the transfer sheet.

FIGS. 17(A)–17(D) show the positional relation of the photoreceptor drum, the transfer roller and an entrance guide plate in the transfer area.

Figure 17:
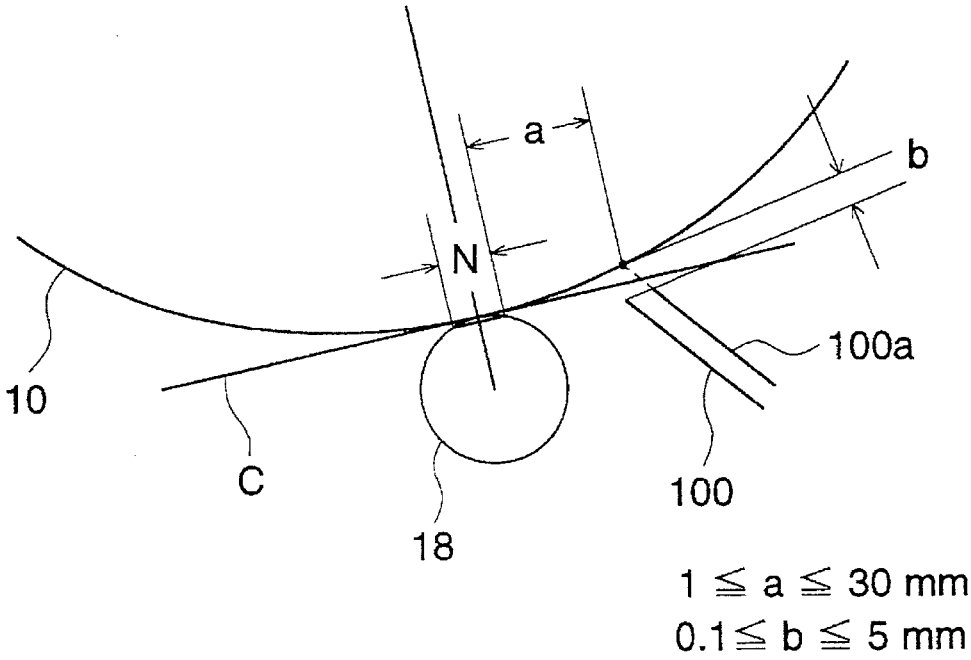
FIGS. 17(A) to 17(D) are views showing relationships of respective positions of a guide plate for the transfer sheet, the photoreceptor drum, and transfer roller.
Figure 17:
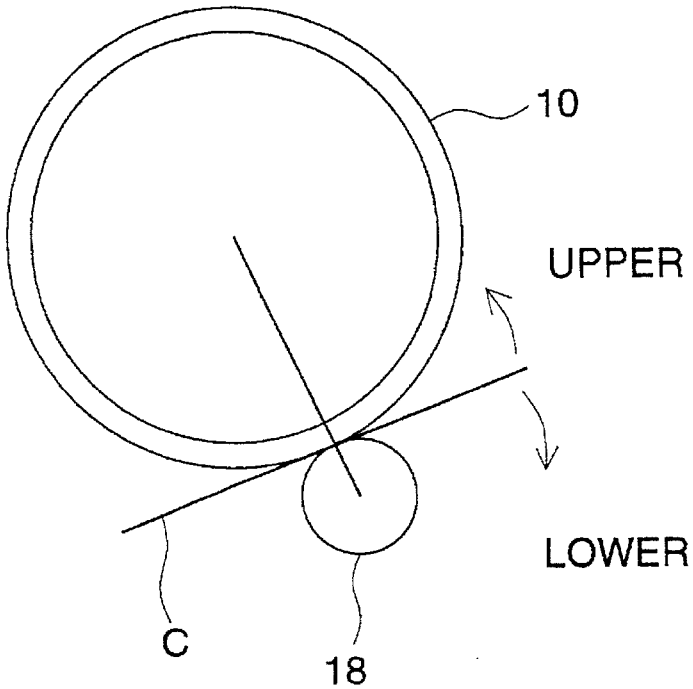
Figure 17:
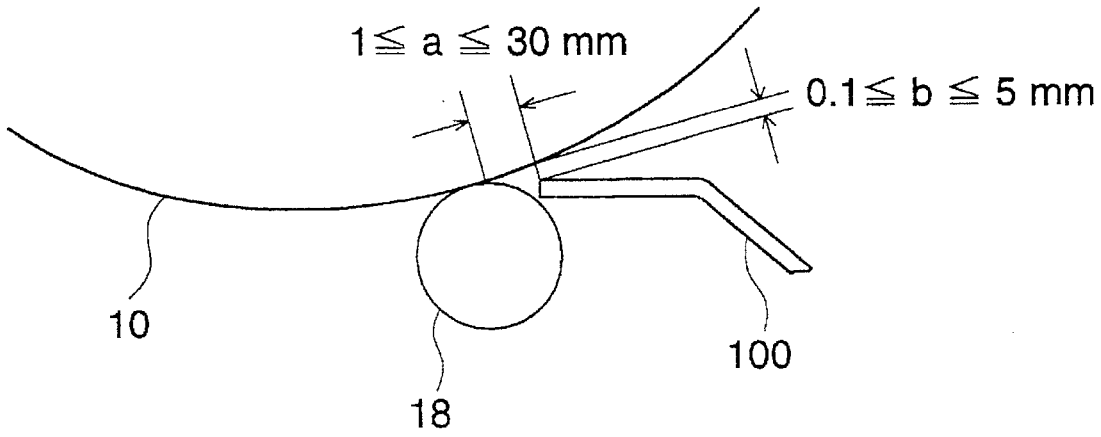
Figure 17:
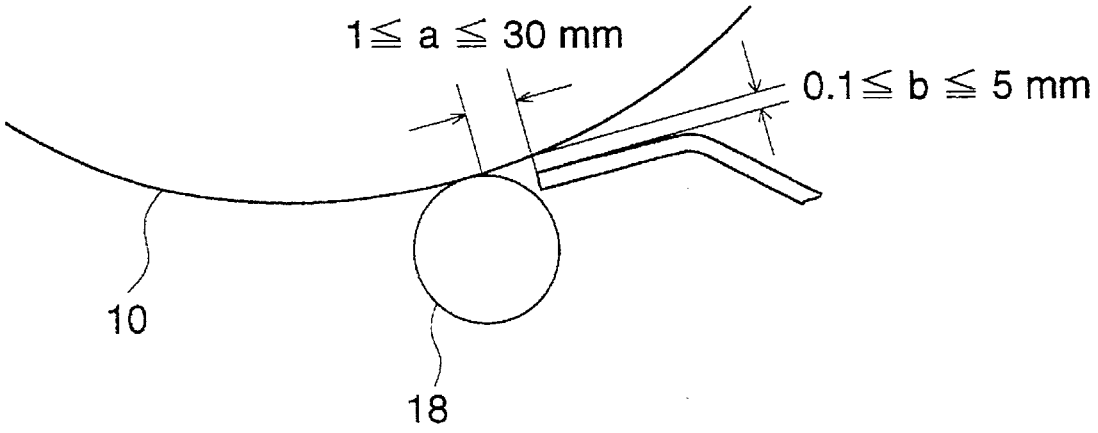

In order to keep the transfer sheet in close contact with the photoreceptor drum 10 at the position preceding the nip formed between transfer roller 18 and the photoreceptor drum 10 in FIG. 17(A), there is used entrance guide plate 100 having a shape wherein a distance between the intersection of a tangent line on the conveyance surface 100*a* of the entrance guide plate 100 for the transfer sheet and the surface of the photoreceptor drum 10 and the point at the upstream side of the nip N formed by transfer roller 18 is in the range from 1 mm to 30 mm, for conveying the transfer sheet to the nip portion of the transfer roller 18.

Further, it is also possible to use, together with the above-mentioned conditions, the entrance guide plate 100 wherein distance b between the tip of the entrance guide plate 100 for the transfer sheet and the photoreceptor drum 10 is within a range from 0.1 mm to 5 mm, for conveying the transfer sheet to the nip portion of transfer roller 18.

Furthermore, for the purpose of conveying the transfer sheet to the nip portion of transfer roller 18, it is possible to use, keeping the aforementioned conditions of $1\ \text{mm} \leqq a \leqq 30$ mm, an entrance guide plate having an angle of 50° upward or 60° downward against nip tangential plane C which passes through the nip portion between the photoreceptor drum 10 and the transfer roller 18 and is perpendicular to the straight line connecting the center of the photoreceptor drum 10 and that of the transfer roller 18, as shown in FIG. 17(B).

FIGS. 17(C) and 17(D) show application examples of entrance guide plates 100 satisfying respectively the aforesaid conditions of $1\ \text{mm} \leqq a \leqq 30$ mm and $0.1\ \text{mm} \leqq b \leqq 5$ mm.

With regard to the shape of a tip of entrance guide plate 100 that is closer to the photoreceptor drum 10, it is preferable that the shape of the tip provides the dimension b that is constant to the utmost along the thickness of the entrance guide plate.

By using the entrance guide plate 100, it is possible to solve the problem of image repelling that takes place in the transfer area and to obtain the stable image density.

Another example of the invention specifically concerning an improvement of separation stability will be explained as follows.

Figure 18:
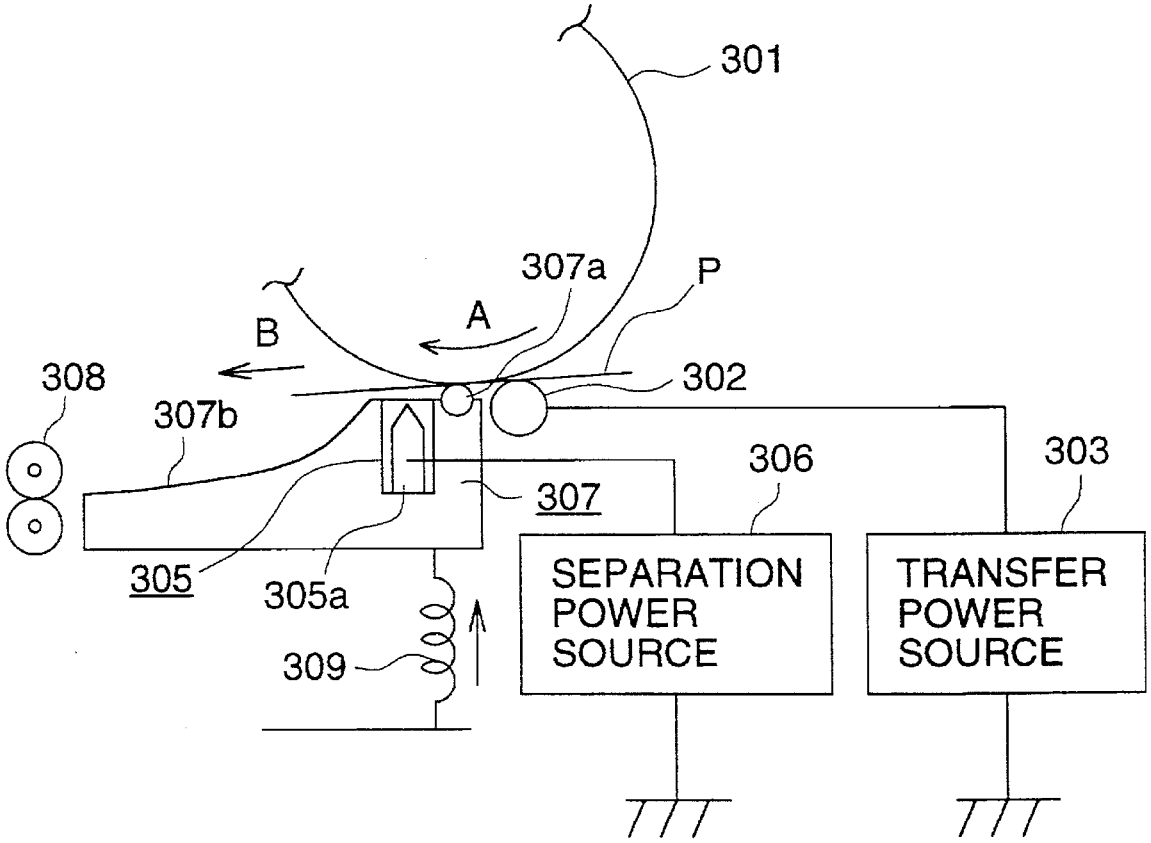
FIG. 18 is a sectional view showing the outline of the primary section of the image forming apparatus provided with a separation apparatus of one example of the present invention.
Figure 19:
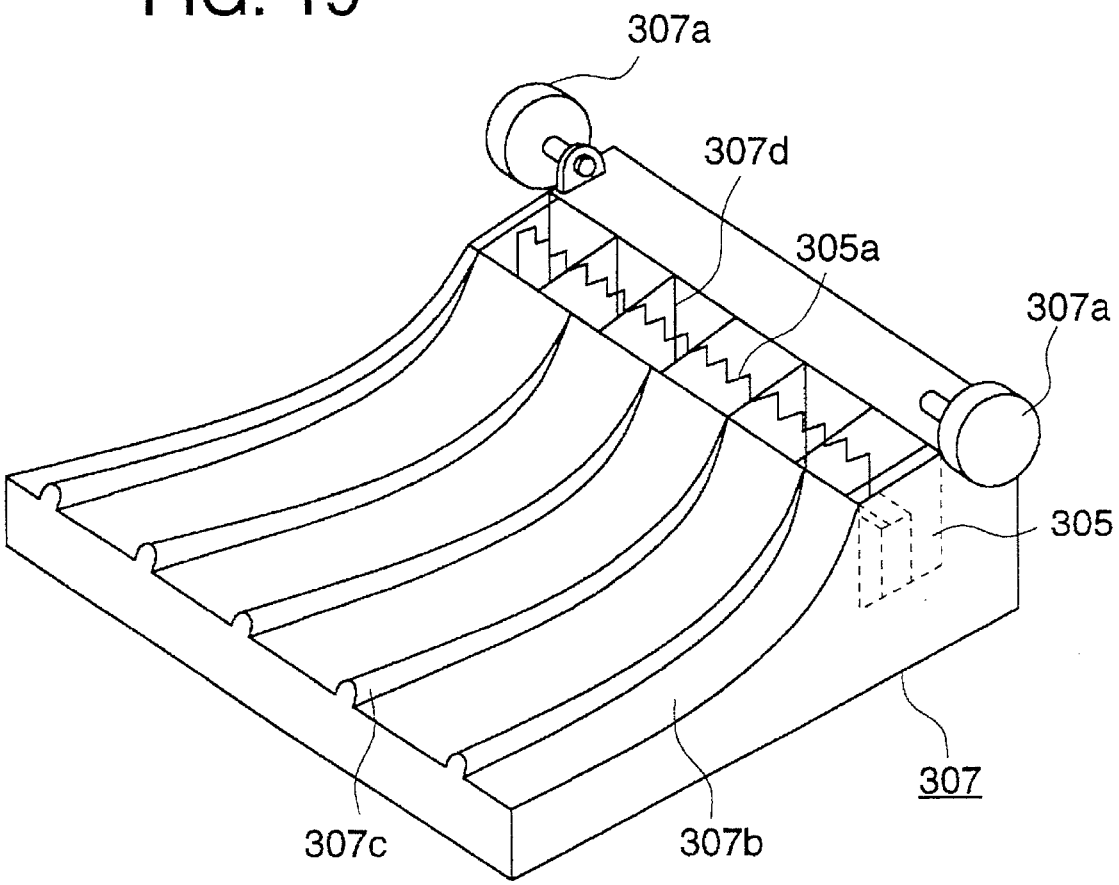
FIG. 19 is a sectional view showing the outline of the separation apparatus and an insulation section of one example of the present invention.

FIG. 18 is a schematic sectional view of the primary portion of an image forming apparatus equipped with a separation apparatus in the present example and FIG. 19 is a schematic perspective view showing a separation apparatus and an insulation portion. Referring to these FIGS. 18 and 19, the explanation will be made as follows.

Transfer roller 302 is provided to face photoreceptor 301 rotating in the direction shown by arrow A, and transfer power source 303 is connected to the transfer roller 302.

When a toner image formed on the photoreceptor 301 by unillustrated charging section, exposure section and developing section arrives at the transfer position on the transfer roller 302, recording sheet P whose timing is controlled is also conveyed to the aforesaid transfer position where transfer bias having the polarity opposite to that of toner is impressed on the recording sheet P through its reverse side, thus, a toner image on the photoreceptor 301 is transferred onto the surface of the recording sheet P by the electrostatic attraction.

On the other hands on the downstream side from the transfer roller 302 in terms of conveyance direction of recording sheet P, there is provided separation portion 305 having neutralizing electrode 305*a* whose tip is of a saw-toothed shape, and the neutralizing electrode 305*a* is connected to power source 306.

The separation portion 305 is shielded entirely with insulation section 307 formed with ABS resin or denaturated PPE ((2,6-dimethyl-1,4-phenylene)ether), or with material containing Teflon in some cases, except a neutralizing surface to prevent an occurrence of leakage through transfer roller 302 which is most probable to occur and to prevent leakage to fixing roller 308 located in the vicinity of the separation portion 305 and to a casing (not shown). In the insulation section 307, there are provided a pair of rotatable insulating rollers 307*a* on the both upper sides, and the insulating rollers 307*a* are brought into contact with the photoreceptor 301 by the pressing force in the arrowed direction of coil spring 309 provided at the lower portion of the insulation section. Thus, the distance between the neutralizing electrode 305*a* and the photoreceptor 301 is kept constant. In addition, conveyance guide 307*b* extending downward obliquely against the conveyance direction of recording sheet P is formed solidly.

Recording sheet P on which a toner image has been transferred by transfer roller 302 shows its tendency to stick to the photoreceptor 301 due to electrostatic attraction caused by electric charges of transfer bias impressed on the reverse side of the recording sheet P. However, when the recording sheet P comes to the separation position on the separation portion 305, electric discharge caused by the neutralizing electrode 305*a* whose polarity is mainly opposite to that in the course of transferring reduces the sticking force, and thereby the leading edge of the recording sheet P is separated from the photoreceptor 301 by its own weight and its stiffness. Owing to the large space kept between the recording sheet P and the conveyance guide 307*b*, the leading edge of the separated recording sheet P is further guided toward the separation direction as the sheet is conveyed. Due to this specific shape of the conveyance guide 307*b*, the separability can be improved through a supplement even when there is a factor impeding the separation.

Figure 20:
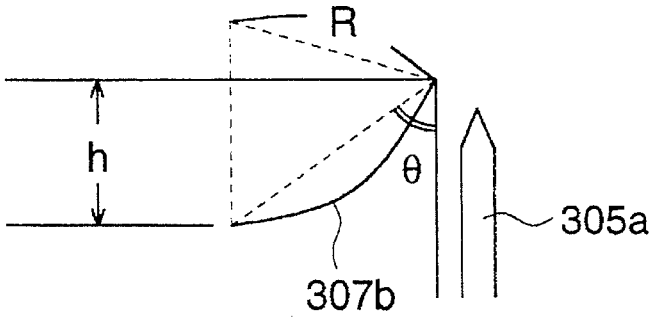
FIG. 20 is an enlarged view showing the outline of an angled portion of a conveyance guide of one example of the present invention.

FIG. 20 shows a schematic enlarged diagram of an inclined portion of the conveyance guide 307*b* wherein R represents a radius of curvature of the inclined portion of the conveyance guide, h represents the distance from the top to the bottom of the inclined portion and θ represents an angle formed between a segment connecting the h position and the top position and a perpendicular line. Owing to the experiments which will be described later, it was possible to obtain ranges of R, H and θ with which the aforementioned effects can be obtained.

Now, factors impeding the separation will be explained in detail as follows.

Firstly, there is given a factor of leakage of the separation portion 305 and the transfer roller 302 as stated above. Both of them are always in potential difference even when they have polarities which are opposite to each other or the same, and they are located to be close each other, thereby leakage tends to occur between them. When there is a leakage, sufficient neutralizing bias can not be obtained in the separation portion 305, resulting in separation failure. With regard to this problem, it can be prevented by the shielding of insulation section 307 as shown in the present example, and it is further possible to arrange the separation portion 305 and the photoreceptor 301 to be close each other because of rollers 307*a*, thereby to reduce leakage through a transfer device by making the clearance between the separation portion and the photoreceptor small to the utmost.

Secondly, there is a problem of fluctuation of neutralizing bias. Namely, when the distance between the neutralizing electrode 305*a* and the photoreceptor 301 is unstable due to the reasons such as assembly accuracy in manufacturing or change with time which can not be avoided in a practical manner, fluctuation is caused in neutralizing bias for recording sheet P, which also results in separation failure. For example, when the distance is 1 mm, necessary voltage for the neutralizing electrode 305*a* is −2 kv, but the distance of 2 mm requires the voltage of −2.5 kv, thus minute variation of the distance has a great influence on the separation capability when the neutralizing voltage is set to the fixed value in advance. In addition, bias voltage sometimes gets out of an appropriate range because neutralizing bias varies depending on paper quality and humidity. With regard to this problem, however, it can be avoided by the inclined conveyance guide 307*b*, and it is further possible to keep the separation capability of the separation portion 305 and to avoid the above-mentioned problem because rotatable rollers 307*a* keep the distance between the separation portion 305 and the photoreceptor 301 constant.

On the other hand, when there is a leakage, sufficient transfer bias can not be obtained on transfer roller 302 and image density is lowered. However, the constitution of the measures for preventing the leakage in the present example is effective for preventing the image density fall.

Figure 21:
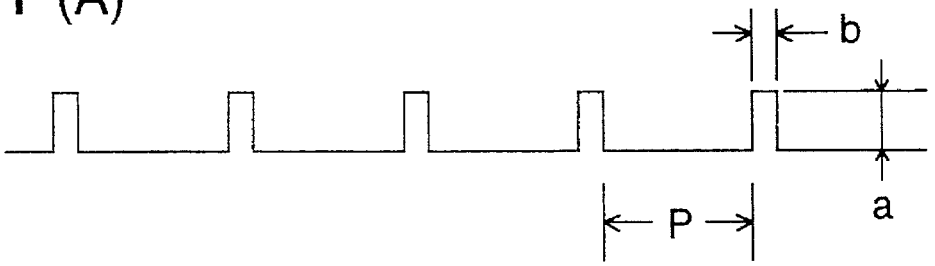
FIGS. 21(A), 21(B) and 21(C) are views showing the outline of the shape of the section of the uneven portion of the conveyance guide of one example of the present invention.
Figure 21:
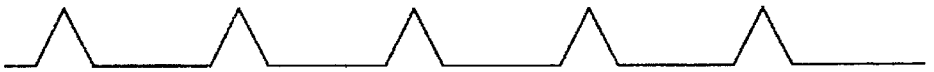
Figure 21:
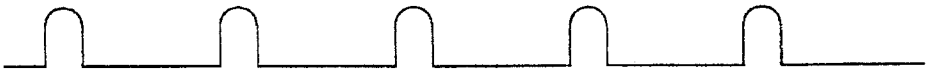

Recording sheet P separated by the separation portion 305 slides on conveyance guide 307*b* and is conveyed to fixing roller 308. In this case, rib 307*c* provided on the conveyance guide 307*b* in the conveyance direction for the recording sheet P reduces the contact area between the conveyance guide and the recording sheet and thereby reduces friction to attain the smooth conveyance of the sheet. Incidentally, the rib 307*c* can take any sectional shape among those shown in FIGS. 21(A)–21(C).

Since insulating portion 307*d* is provided on the neutralizing plane where separation portion 305 faces the photoreceptor 301 so that an opening may be left on the neutralizing plane, it does not happen that the leading edge of the recording sheet is caught by a separating device to cause jamming in the course of separation and that white streaks are caused by the flapping of the recording sheet. With regard to the opening, when the rate of opening is high, the separability is improved, but the possibility that the recording sheet P conveyed to the separation portion 305 is jammed is increased accordingly. In the present example, therefore, it is preferable that the rate of opening is not less than 50% from the viewpoint of balance with a jam.

Next, examples will be explained as follows.

In the case of the constitution wherein the transfer roller 302 has an inner layer made of ether type foaming urethane (made by Hokushin Kogyo Co., $10^5$–$10^6$ Ω·cm) and an outer layer made of ester type urethane solid type (made by Hokushin Kogyo Co., $10^{10}$–$10^{11}$ Ω·cm) ($10^7$–$10^8$ Ω·cm for both inner and outer layers), a conductive separating brush (made by Achilles Co., Non-spark S Type, stainless fiber, pitch 0.8 mm, bristle length 3 mm, distance from drum 0.5 mm) is used for neutralizing electrode 305*a*, ABS resin (containing Teflon) is used for insulation section 307 and 307*d*, R=10 cm, θ=70° and h=1 cm, a white streak occurrence rate and a jam occurrence rate were respectively 0.7% and 0.2% for the constitution having no insulation section, while they were respectively 0% and 0% for the constitution having an insulation section.

In the case of the constitution wherein a transfer brush (made by Achilles Co., Non-spark 4S Type (3S Type and 3C Type can also be used)) is used in place of a transfer roller, a stainless pointed electrode (pitch 1.5 mm, height 3 mm, thickness 150 μm, distance from drum 0.5 mm) is used as neutralizing electrode 305*a*, ABS resin (containing Teflon) is used for insulation section 307 (pitch of rib 307*c* is 10 mm and height thereof is 5 mm), 20 mm-interval flocked nylon having a diameter of 100 μm, R=20 cm, θ=45° and h=3 cm, a white streak occurrence rate and a jam occurrence rate were respectively 0.4% and 0.2% for the constitution having no insulation section, while they were respectively 0% and 0.1% for the constitution having an insulation section.

In the case of the constitution wherein the transfer roller 302 has an inner layer made of ether type foaming urethane (made by Hokushin Kogyo Co., $10^5$–$10^6$ Ω·cm) and an outer layer made of ester type urethane solid type (made by Hokushin Kogyo Co., $10^{10}$–$10^{11}$ Ω·cm) ($10^7$–$10^8$ Ω·cm for both inner and outer layers), a bronze pointed electrode (pitch 2 mm, height 3 mm, thickness 200 μm, distance from drum 2 mm) is used as neutralizing electrode 305*a*, denaturated PPE (containing Teflon) is used for insulation section 307 and 307*d* (pitch of rib 307*c* is 10 mm and height thereof is 5 mm), an insulating roller is provided, R=15 cm, θ=50° and h=2 cm, a white streak occurrence rate and a jam occurrence rate were respectively 0.7% and 0.3% for the constitution having no insulation section, while they were respectively 0.1% and 0.1% for the constitution having an insulation section.

As stated above, it is understood that occurrence of white streaks and jam can be prevented by the insulation section 307*d* as shown by the occurrence rate of both white streaks and jam.

Next, in the case of the constitution wherein the transfer roller 302 has an inner layer made of carbon black-containing rubycell and an outer layer made of adipate type urethane (made by Nitto Kogyo Co., $10^7$–$10^8$ Ω·cm Hi-denso coat), a bronze pointed electrode (pitch 2 mm, height 4 mm, thickness 500 μm, distance from drum 0.5 mm) is used as neutralizing electrode 305*a*, ABS resin (containing Teflon) is used for insulation section 307 (pitch of rib 307*c* is 20 mm and height thereof is 3 mm), PET having a diameter of 50 μm is used for insulation section 307*d*, R=30 cm, θ=60° and h=2 cm, the jam occurrence rate was 0.7% for the constitution having no inclination of conveyance guide 307*b* and it was 0% for the constitution having the inclination of conveyance guide 307*b*.

In the case of the constitution wherein the transfer roller 302 is made of carbon black-containing rubycell (made by Nitto Kogyo Co., $10^5$–$10^6$ Ω·cm monolayer), a separating brush made of conductive stainless fiber (made by Achilles Co., Non-spark 4S Type, pitch 2 mm, bristle length 4 mm, distance from drum 1 mm) is used for neutralizing electrode 305*a*, denaturated PPE (containing Teflon) is used for insulation section 307, nylon having a diameter of 100 μm is used for insulation section 307*d*, R=20 cm, θ=50° and h=3 cm, the jam occurrence rate was 0.9% for the constitution having no inclination of conveyance guide 307*b* and it was 0.1% for the constitution having the inclination of conveyance guide 307*b*.

Figure 22:
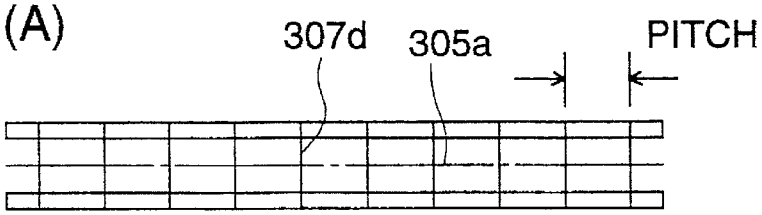
FIGS. 22(A) to 22(F) are plan views showing the outline of the primary portion of the insulation section of one example of the present invention.
Figure 22:
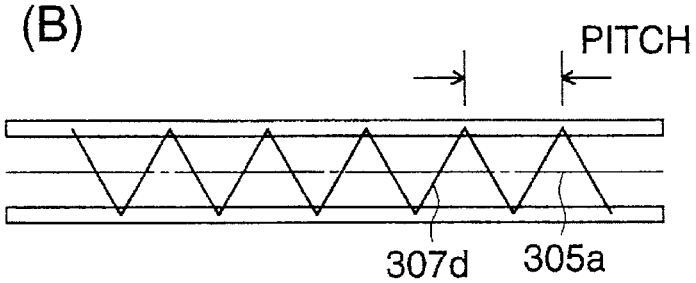
Figure 22:
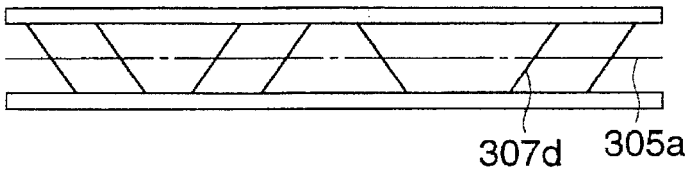
Figure 22:
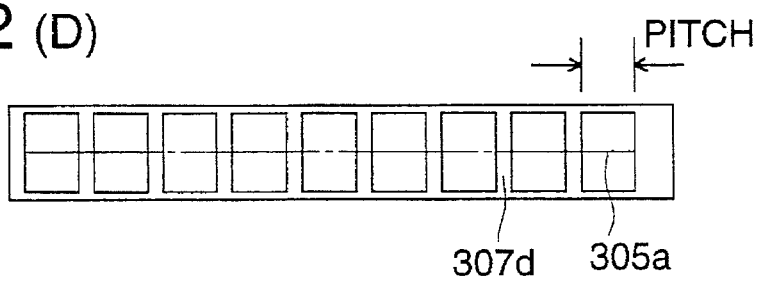
Figure 22:
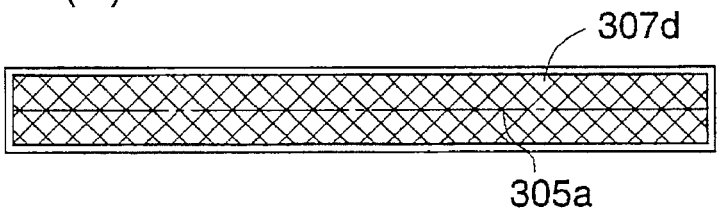
Figure 22:
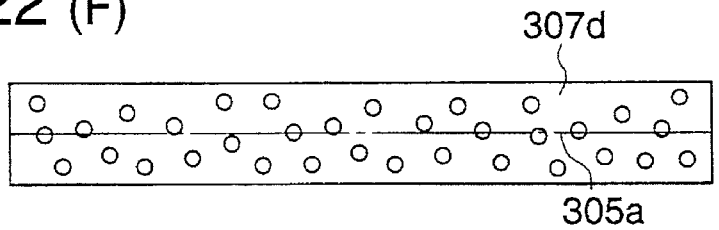
Figure 23:
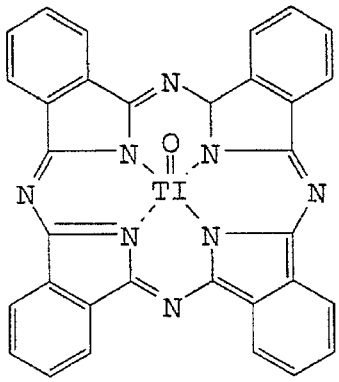
FIG. 23(A) is a view showing a carrier generation material (C1) of an organic photoreceptor (OPC).
FIG. 23(B) is a view showing spectral characteristics of X-ray diffraction of the carrier generation material (C1).
FIG. 23(C) is a view showing carrier transport material (D1) of the organic photoreceptor (OPC).
Figure 23:
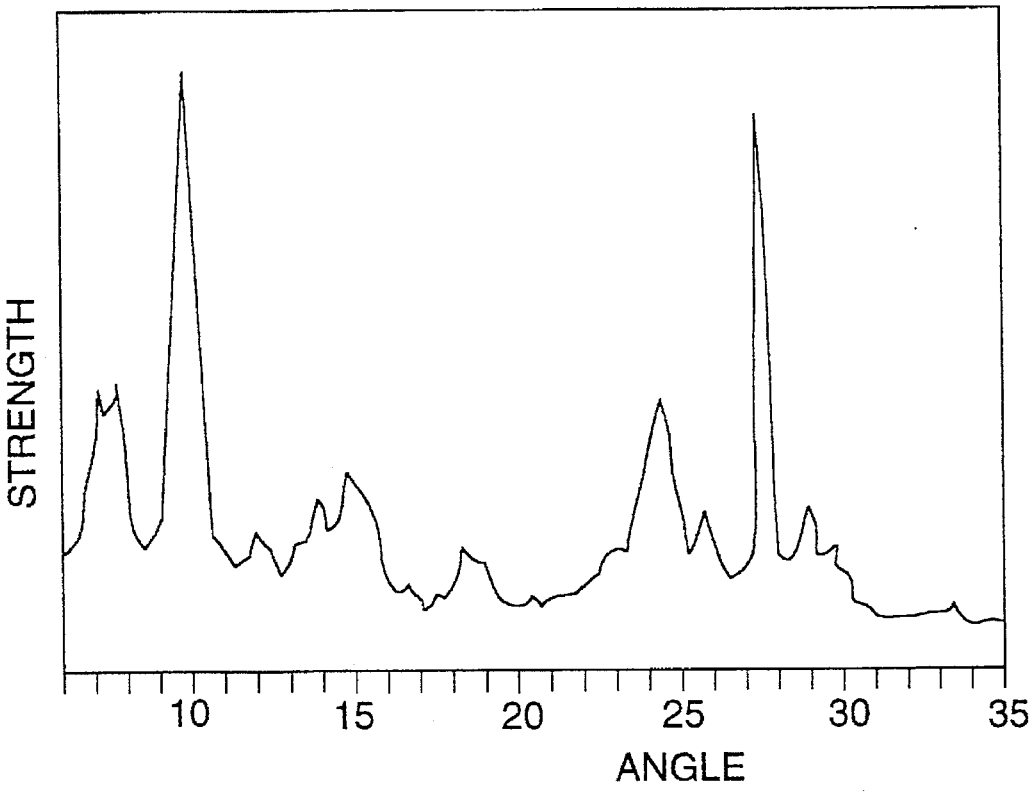
Figure 23:
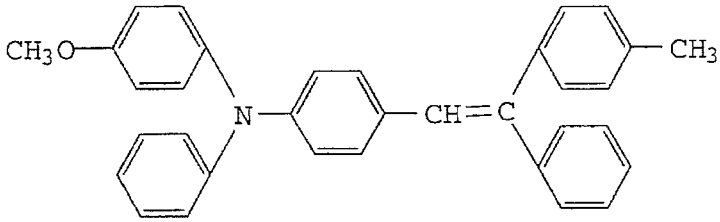

Denaturated PPE, ABS resin, PET and Teflon can be used for insulation section 307 and nylon, PET and Teflon can be used for insulation section 307*d*, and shapes shown in FIGS. 22(A)–22(F) can be used. Namely, FIGS. 22(A)–22(C) represent a wire type, FIG. 22(D) represents a solid type insulation section, FIG. 22(E) is a mesh type and FIG. 22(F) represents a solid type. As a separation electrode, conductive brushes as shown in FIGS. 5(A)–5(E) can be used.

With regard to a transfer roller, it is preferable that a roller is made of foaming polyurethane or foaming silicone when the roller is of a monolayer type, an inner layer is made of foaming polyurethane or foaming silicone and an outer layer is made of polyfluorovinylidene (PVDF), adipate polyurethane, or ester urethane solid type when a roller is of a multi-layer type, hardness is 20–50 (measured with an Asker C scale hardness tester based on JIS Standards K-6301) and a roller diameter is 10–30 mm. Further, the distance between photoreceptor 301 and separation section 305 is preferably 0.2 mm–5 mm.

From the results of experiments mentioned above, conveyance guide 307*b* satisfying the conditions of $40° \leqq \theta \leqq 85°$, $0.5\ cm \leqq h \leqq 5\ cm$, and $2\ cm \leqq R \leqq 50\ cm$ in FIG. 20 is preferable. Further, in FIGS. 21(A)–21(C), it was found that rib 307*c* satisfying the conditions of $1\ mm \leqq P \leqq 100\ mm$, $1\ mm \leqq a \leqq 20\ mm$ and $1\ mm \leqq b \leqq 30\ mm$ can be used.

Incidentally, the invention can be applied to an image forming apparatus wherein toner images of two or more colors are formed and also to a non-contact two-component reversal developing system wherein voltage of DC component and voltage of AC component are superimposed on a developing area where two-component developing agents are used. Namely, the developing system is not restricted and the invention can be applied to both a reversal developing system and a regular developing system.

As stated above, in a device for separating a transfer material equipped on an image forming apparatus having the constitution mentioned above, the separating device is insulation-shielded entirely by an insulation shielding means except the surface facing an image-carrier. Therefore, it is possible to prevent leakage not only to a transfer unit but also to other peripheral components. In addition to that, the surface of the separating device facing the image-carrier is also covered by insulating materials which prevent the transfer material from being caught by the separating device even when the transfer material bumps.

In the case of the constitution wherein both sides of an insulation shielding means are brought into contact with an image-carrier and thereby the distance from the image-carrier can be regulated, it is possible to maintain the separating capability by means of bias voltage and to make the clearance between an intermediate portion of the insulation shielding means and the image-carrier small sufficiently. Therefore, it is possible to reduce to the utmost a leakage to a transfer unit which has a great influence in particular.

In the case of the structure wherein both sides of the insulation shielding means are in rolling contact with the image-carrier through rollers in the above-mentioned constitution, operation is smooth without being caught and the rollers are not worn away even when they are used for a long time, thus the established distance can be maintained.

Further, on the insulation shielding means equipped with a conveyance guide that extends downward obliquely, the separated leading edge of the transfer material is quickly guided downward due to its own weight and stiffness to escape from an influence of the image-carrier, resulting in easy separation and improvement in separability.

In the case of an insulation shielding means equipped with an insulating conveyance guide having thereon unevenness, a transfer material can be conveyed smoothly due to the reduction of a contact area between the transfer material and the conveyance guide.

A separating unit wherein a pointed electrode or a conductive brush is used as a separation electrode and a transfer means which is of a type of a transfer roller or a transfer brush can be applied also to an image forming apparatus having an image-carrier on which toner images with two or more colors are formed and a non-contact 2-component reversal developing unit.

What is claimed is:

1. An image forming apparatus comprising:

(a) a photoreceptor having a radius of curvature of more than 35 mm at a transfer position;

(b) a roller-shaped transfer device provided at the transfer position where said transfer device faces said photoreceptor, for transferring a toner image formed on said photoreceptor onto a recording sheet;

(c) a first power supply source for supplying a predetermined DC bias current onto said transfer device;

(d) a conductive brush-shaped separation device provided at a separation position downstream of the transfer position with respect to a conveyance direction of the recording sheet, where said separation device faces said photoreceptor, for separating the recording sheet from said photoreceptor; and (e) a second power supply source for supplying a variable DC bias voltage onto said separation device, the said conductive brush-shaped separation device comprises:

a neutralizing electrode disposed at the separation position and connected with said second power supply source for separating a recording sheet from said photoreceptor;

insulation shielding means made of an electrically insulation material, having an opening which faces said photoreceptor and has a predetermined width with respect to the conveyance direction of the recording sheet at the separation position for surrounding and shielding said neutralizing electrode except for said opening;

an insulation member made of insulation material and disposed on a top portion of said insulation shielding means so as to connect two ends of said opening in the conveyance direction of the recording sheet and thereby to partially shield said opening;

a pair of rotating insulation rollers provided on both upper sides of said insulation shielding means, for regulating a distance between said photoreceptor and said neutralizing electrode by being brought into contact with said photoreceptor when said insulation shielding means is lifted up;

an insulation conveyance guide disposed on said insulation shielding means and formed at a tilting downward angle in the downstream of the conveyance direction of the recording sheet for guiding the recording sheet; and a plurality of ribs provided on a top surface of said insulation conveyance guide, said plurality of ribs extending in the conveyance direction of the recording sheet, for guiding the recording sheet.

2. The image forming apparatus of claim 1 further comprising:

a humidity sensor provided below said separation device for sensing an environmental humidity inside said apparatus, wherein said second power supply source is controlled to supply a variable DC bias voltage to said separation device in accordance with an output from said humidity sensor.

3. The image forming apparatus of claim 1 further comprising a temperature sensor provided below said separation means for sensing an environmental temperature inside said apparatus, wherein said second power supply source is controlled to supply a variable DC bias voltage to said separation device in accordance with an output from said temperature sensor.

4. The image forming apparatus of claim 1, wherein said second power supply source further supplies an AC bias current, which is superimposed on the variable DC bias voltage, onto said separation device.

5. An image forming apparatus comprising:

(a) a photoreceptor having a radius of curvature of more than 35 mm at a transfer position;

(b) a roller-shaped transfer device provided at the transfer position where said transfer device faces said photoreceptor, for transferring a toner image formed on said photoreceptor onto a recording sheet;

(c) a first power supply source for supplying a predetermined DC bias current onto said transfer device;

(d) a conductive brush-shaped separation device provided at a separation position downstream of the transfer position with respect to a conveyance direction of the recording sheet, where said separation device faces said photoreceptor, for separating the recording sheet from said photoreceptor; and (e) a second power supply source for supplying a variable DC bias voltage onto said separation device;

(f) an entrance guide plate provided upstream of a nip which is formed between said transfer device and said photoreceptor, for guiding the recording sheet into the nip, wherein said entrance guide plate has a shape in which a distance between the intersection of a tangent line on a conveyance surface of said entrance guide plate and a point at an upstream side of the nip formed by said transfer device is in a range from 1 mm to 30 mm, and wherein said entrance guide plate is provided such that a distance between a tip of said entrance guide plate and said photoreceptor is within a range from 0.1 mm to 5 mm, and further wherein said entrance guide plate has an angle of 50° upward or 60° downward against a nip tangential plane which passes through the nip between said photoreceptor and said transfer device to a straight line, and is perpendicular to the straight line connecting a center of said photoreceptor and that of said transfer device.

6. The image forming apparatus of claim 5, wherein each different color toner is superimposed on said photoreceptor before a transfer operation by said transfer device is conducted.

7. An image forming apparatus comprising:

(a) a photoreceptor having a radius of curvature of more than 35 mm at a transfer position;

(b) a roller-shaped transfer device provided at the transfer position where said transfer device faces said photoreceptor, for transferring a toner image formed on said photoreceptor onto a recording sheet;

(c) a first power supply source for supplying a predetermined DC bias current onto said transfer device;

(d) a conductive brush-shaped separation device provided at a separation position downstream of the transfer position with respect to a conveyance direction of the recording sheet, where said separation device faces said photoreceptor, for separating the recording sheet from said photoreceptor; and (e) a second power supply source for supplying a variable DC bias voltage onto said separation device and wherein said predetermined DC bias current onto said transfer device and said variable DC bias voltage onto said separation device satisfy the following conditions:

predetermined DC bias current=(40 $nC/cm^2$ to 200 $nC/cm^2$)×S×W and variable DC bias voltage=+4.0 to −4.0 KV where S represents a circumference speed of said photoreceptor, W represents a width of said roller-shaped transfer device.

8. The image forming apparatus of claim 7, wherein said first power supply source is controlled to supply a variable DC bias current to said transfer device.

9. The image forming apparatus of claim 8 further comprising:

a humidity sensor provided below said separation device for sensing an environmental humidity inside said apparatus, wherein said first power supply source is controlled to supply a variable DC bias current to said transfer device in accordance with an output from said humidity sensor.

10. The image forming apparatus of claim 9 further comprising a temperature sensor provided below said separation means for sensing an environmental temperature inside said apparatus, wherein said first power supply source is controlled to supply a variable DC bias current to said transfer device in accordance with an output from said temperature sensor.

11. The image forming apparatus of claim 7, wherein said first power supply source further supplies an AC bias current, which is superimposed on the variable DC bias current, onto said transfer device.

12. The image forming apparatus of claim 7, wherein said photoreceptor comprises a drum type photoreceptor.

13. The image forming apparatus of claim 7, wherein said photoreceptor comprises a belt type photoreceptor.

* * * * *